US011193231B2

(12) United States Patent
Lee et al.

(10) Patent No.: US 11,193,231 B2
(45) Date of Patent: Dec. 7, 2021

(54) WASHING MACHINE AND TUB FOR WASHING MACHINE

(71) Applicant: LG Electronics Inc., Seoul (KR)

(72) Inventors: Hyunseung Lee, Seoul (KR); Sanghee Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 67 days.

(21) Appl. No.: 16/427,535

(22) Filed: May 31, 2019

(65) Prior Publication Data

US 2019/0368104 A1 Dec. 5, 2019

(30) Foreign Application Priority Data

Jun. 1, 2018 (KR) ..... 10-2018-0063775

(51) Int. Cl.
*D06F 37/26* (2006.01)

(52) U.S. Cl.
CPC ..... *D06F 37/263* (2013.01)

(58) Field of Classification Search
CPC ..... D06F 37/26; D06F 37/261; D06F 37/262; D06F 37/263; D06F 37/264
See application file for complete search history.

(56) References Cited

U.S. PATENT DOCUMENTS

2007/0289339 A1 12/2007 Lim
2008/0276658 A1* 11/2008 Gweon ..... D06F 37/267 68/139
2009/0165506 A1 7/2009 Marquina et al.
2012/0000253 A1 1/2012 Moon et al.
2012/0042699 A1 2/2012 Kwon et al.
(Continued)

FOREIGN PATENT DOCUMENTS

CN 200967891 10/2007
CN 201071461 6/2008
CN 101824726 9/2010
(Continued)

OTHER PUBLICATIONS

European Search Report dated Aug. 2, 2019.
Office Action in Chinese application No. 201910469293.0 dated Dec. 23, 2020.

*Primary Examiner* — David G Cormier
(74) *Attorney, Agent, or Firm* — Finnegan, Henderson, Farabow, Garrett & Dunner, LLP

(57) ABSTRACT

A washing machine includes a cabinet, a tub disposed inside the cabinet to form a washing space in which washing water is filled, and a drum rotatably supported in the washing space for receiving laundry. The tub includes a first case coupled to a second case to form the washing space. A first coupling surface is formed along a periphery of an opened end portion of the first case and a second coupling surface is formed along a periphery of an opened end portion of the second case facing the first case. The second coupling surface is welded to the first coupling surface. A coupling protrusion protrudes along the first coupling surface and includes a protruding end portion welded to the second coupling surface. The coupling protrusion includes a main-coupling protrusion protruding along the first coupling surface and a sub-coupling protrusion parallel to and spaced apart from the main-coupling protrusion.

17 Claims, 13 Drawing Sheets

(56) References Cited

U.S. PATENT DOCUMENTS

2017/0152624 A1 6/2017 Erickson et al.

FOREIGN PATENT DOCUMENTS

| | | | | |
|---|---|---|---|---|
| CN | 202064188 | | 12/2011 | |
| CN | 107012639 | | 8/2017 | |
| CN | 206512471 | | 9/2017 | |
| EP | 0854223 | | 7/1998 | |
| EP | 3176303 | | 6/2017 | |
| KR | 10-2006-0089786 | A | 9/2006 | |
| KR | 100777299 | | 11/2007 | |
| KR | 20110033412 | | 3/2011 | |
| WO | WO 2007/115894 | | 10/2007 | |
| WO | WO-2007115904 | A1 * | 10/2007 | ..... D06F 37/20 |
| WO | WO 2007/129354 | | 11/2007 | |
| WO | WO 2010077105 | | 12/2010 | |
| WO | WO 2010137908 | | 12/2010 | |

* cited by examiner

WASHING MACHINE AND TUB FOR WASHING MACHINE

CROSS-REFERENCE TO RELATED APPLICATION

The present application claims priority under 35 U.S.C. 119 and 35 U.S.C. 365 to Korean Patent Application No. 10-2018-0063775 (filed on Jun. 1, 2018), which is hereby incorporated by reference in its entirety.

BACKGROUND

The present invention relates to a washing machine and a tub for a washing machine.

Generally, a washing machine is a device for cleaning laundry by washing, rinsing, dewatering, drying processes, and the like so as to remove contamination from clothes, bedding, or the like. (hereinafter, referred to as laundry) by using water, detergent, mechanical action and the like.

Such a washing machine may include a cabinet which forms an outer appearance, a tub which is installed inside the cabinet, a drum which is rotatably installed inside the tub and provided with a plurality of through-holes through which washing water or foam enters and exits, and a motor which is installed on the tub and rotates the drum. The rotational shaft of the motor may be connected to the drum through one side of the tub.

The tub forms a washing space in which the drum is received and opens to the inlet side through which the laundry of the washing machine enters and exits to form a passage through which laundry is introduced into the drum.

When the washing machine is operated for washing laundry, washing water for washing is supplied to the inside of the tub, and the drum is rotated by the motor when the washing water sufficiently contains in the tub. The washing water in the tub exits and exits through a plurality of through-holes formed in the drum and laundry received in the drum is washed.

In addition, when the washing is completed, the drain pump provided in the washing machine is operated, and the washing water in the tub can be discharged to the outside.

Meanwhile, the external shape of the tub can be formed by combining a plurality of divided configurations. In other words, the tub may be manufactured in a state where the drum is received therein by a combination of a plurality of divided configurations. The plurality of divided configurations of the tub may each form a portion of the washing space of the tub.

For example, the tub may be formed in a substantially cylindrical shape and may include a first case forming half of the cylindrical shape and a second case forming the other half thereof.

In the related art, a gasket for sealing is provided on a contact surface between the first case and the second case, and a coupling structure in which the first case and the second case are coupled by a fastening member such as a bolt is applied.

Korean Patent Laid-Open No. 10-2006-0089786 which is the related art discloses a structure in which a tub 58 of a washing machine is formed in an external shape by a combination of a tub cover 90 and a tub main body 92.

According to the related art, the tub cover forms a front portion of the tub, and the tub main body is configured to form a rear portion of the tub. In addition, there is provided a structure in which the tub cover and the tub main body are formed with holes formed along the outer periphery thereof and the fastening members are fastened to the holes and thus coupled to the holes.

However, in a case where the first case and the second case forming the tub are coupled by the fastening member as in the related art, after the gasket is provided between the first case and the second case, the fastening member has to be fastened to the plurality of holes formed along the outer periphery of the first case and the second case.

Therefore, there is a problem that the number of working hours for assembling the tub increases, and thus the manufacturing time of the washing machine is increased.

In addition, due to an increase in the configuration of the gasket and the fastening member, the tub may be easily misassembled and the cost of components may increase.

In addition, in a case where the fastening force of the fastening member is reduced or the gasket is aged, a problem may occur that the washing water leaks between the first case and the second case.

SUMMARY

An objective of the present invention is to provide a tub of a washing machine in which the first case and the second case forming the external shape of the tub of the washing machine can be easily combined by a welding process, and a washing machine having the same.

An objective of the present invention is to provide a tub of a washing machine which can be welded so that the first case and the second case prevents water leakage, and a washing machine having the same.

An objective of the present invention is to provide a tub of a washing machine in which the flash generated during welding of the first case and the second case is prevented from being introduced into the inside, and a washing machine having the same.

A washing machine according to an embodiment of the present invention includes a cabinet in which space is formed; a tub which is provided inside the cabinet to form a washing space in which washing water is filled; and a drum which is rotatably provided in the washing space and in which laundry is received, in which the tub may include a first case and a second case which are coupled to each other to form the washing space; a first coupling surface which is formed along a periphery of an opened end portion of the first case; a second coupling surface which is formed along a periphery of an opened end portion of the second case facing the first case, the second coupling surface being bonded to the first coupling surface by welding; and a coupling protrusion which is formed so as to protrude along the first coupling surface and in which a protruding end portion is welded to the second coupling surface, and in which the coupling protrusion may include a main-coupling protrusion which protrudes along the first coupling surface; and a sub-coupling protrusion which protrudes in parallel with the main-coupling protrusion at a position spaced apart from the main-coupling protrusion.

The first coupling surface and the second coupling surface may extend outward along the periphery of the opened end portions of the first case and the second case, respectively.

The thickness of the main-coupling protrusion may be formed thicker than the thickness of the sub-coupling protrusion.

The main-coupling protrusion may be formed over the entire first coupling surface, and the sub-coupling protrusion may be partially formed in a region of a portion of the first coupling surface.

The sub-coupling protrusion may be positioned closer to the washing space than the main-coupling protrusion.

The first coupling surface and the second coupling surface may include a side-end section having a narrower width at a position facing both side surfaces of the cabinet in a lateral direction.

The side-end section may be formed in a straight shape extending in parallel with both side surfaces of the cabinet in a vertical direction, and the distance between the side-end section and the inside surface of the cabinet may be formed to be closer than the distance between the upper and lower ends of the tub and the upper and lower ends of the cabinet.

The sub-protrusions may be formed along the first coupling surface excluding the side-end section.

The first coupling surface and the second coupling surface may further include an upper-end section which has a narrower width at a position facing the upper surface of the cabinet, and the sub-protrusions may be formed along the first coupling surface excluding the side-end section and the upper-end section.

The main-protrusions and the sub-protrusions may be formed to have the same height.

The first coupling portion may be formed with a connection rib which connects between the main-protrusion and the sub-protrusion.

A plurality of connection ribs may be disposed at predetermined intervals along between the main-protrusion and the sub-protrusion.

The connection rib may extend in a direction intersecting with the main-protrusion and the sub-protrusion.

The first coupling surface and the second coupling surface may be formed with a lower end section in a region corresponding to a portion in which washing water is collected at the lower end of the tub, and an interval between the connection ribs may be formed to be narrower in the lower end section.

The washing machine of claim may further include a blocking protrusion which is formed to protrude toward the first coupling surface along the second coupling surface and positioned inside the washing space than the coupling portion to block flash generated during welding of the coupling protrusion from flowing into the washing space.

The blocking protrusion may be formed to be shorter than the protruding length of the coupling protrusion.

The washing machine may further include a guide protrusion which protrudes inside the coupling protrusion in the second coupling surface and guides the coupling protrusion to a setting position of the second coupling surface while being in contact with the coupling protrusion when the first case and the second case are coupled.

The guide protrusion may include an inclined surface which is formed to be inclined from the protruding end portion of the guide protrusion toward the second coupling surface and guides movement of the guide protrusion in contact with the end portion of the coupling protrusion; and a supporting portion which connects the second coupling surface at a lower end of the inclined surface and supports the coupling protrusion in an inner direction.

The guide protrusion may be formed along the side-end section.

A tub for a washing machine according to an embodiment of the present invention includes a first case and a second case which are coupled to each other to form a washing space in which a drum of the washing machine is received; a first coupling surface and a second coupling surface which extend outwardly from facing end portions of the first case and the second case; and a coupling protrusion which protrudes along the first coupling surface and is in contact with the second coupling surface, and to which the protruding end portion is welded to the second coupling surface, in which the coupling protrusion may include a main-coupling protrusion which protrudes along a periphery of the first case; and a sub-coupling protrusion which protrudes in parallel to the main-coupling protrusion at a position spaced apart from the main-coupling protrusion toward the washing space, and in which the first coupling surface may include a double coupling section in which the main-coupling protrusion and the sub-coupling protrusion are formed together; and a single coupling section which has a narrower width than the double coupling section and in which main-coupling protrusion excluding the sub-coupling protrusion is formed.

According to the tub of the washing machine and the washing machine having the same according to the embodiment of the present invention, the following effects can be expected.

First, a first coupling surface and a second coupling surface facing each other are formed on the first case and the second case so that the first case and the second case forming the tub are coupled by welding. In addition, the first coupling surface is provided with coupling protrusions for coupling the first case and the second case by a welding process.

At this time, the coupling protrusion includes a main-coupling protrusion formed along the first coupling surface and a sub-coupling protrusion spaced inward from the main-coupling protrusion. The coupling structure of the tub may have a dual structure of the main-coupling protrusion and the sub-coupling protrusions so that a more strong welding coupling can be made and leakage of water between the first case and the second case can be effectively prevented.

In addition, since the sub-coupling protrusions are formed to be thinner than the main-coupling protrusions, the main-coupling protrusions and the sub-coupling protrusions are all disposed within the region of the narrow first coupling surface so that effective welding operation can be performed.

Second, a plurality of connection ribs which connects the main-coupling protrusion and the sub-coupling protrusion are provided between the main-coupling protrusion and the sub-coupling protrusion. The main-coupling protrusions and the sub-coupling protrusions may have structures which are supported by each other by the plurality of connection ribs, and the strength of the main-coupling protrusions and the sub-coupling protrusions may be reinforced.

Therefore, it is possible to prevent the main-coupling protrusion and the sub-coupling protrusion from being folded or broken during an external impact or a welding process. Further, as the strength of the main-coupling protrusion and the sub-coupling protrusion is reinforced, the first case and the second case can be more firmly coupled.

Thirdly, the connection rib is protruded at a height corresponding to the height of the coupling protrusion before welding. Therefore, the connection ribs can also be welded together when the coupling protrusions are welded. Therefore, the coupling strength between the first case and the second case can be further improved by the connection ribs.

Fourth, the first coupling surface extends outside the peripheral surface of the first case, and the second coupling surface extends outside the peripheral surface of the second casing. Therefore, an area in which the welding apparatus can be in contact with and pressed to the first coupling surface and the second coupling surface from the outside can be secured.

At this time, since the main-coupling protrusion is positioned outside the sub-coupling protrusion and thus vibration due to the welding apparatus can be effectively transmitted, even if the main-coupling protrusion is thicker than the sub-coupling protrusion, the main-coupling protrusion can be stably welded, and the first case and the second case can be more firmly coupled.

The sub-coupling protrusions are formed to be thinner than the main-coupling protrusions so that the sub-coupling protrusions are positioned inside the main-coupling protrusions and can be stably welded even if the vibration due to the welding apparatus is transmitted somewhat weakly.

Fifth, generally in a case of a drum type washing machine in which an entrance is formed in a front surface of a cabinet, the inner space of the cabinet is formed to be smaller in width in a lateral direction than the height in a vertical direction. Correspondingly, the outer end portions of the first and second coupling surfaces positioned at the sides of the washing space in a lateral direction are formed in a straight line shape so as not to interfere with the side surfaces of the inner space of the cabinet in the lateral direction and have a relatively narrow width. In addition, only the main-coupling protrusions may be formed on the first coupling surface and the second coupling surface, which are positioned at the sides of the washing space in the lateral direction and are narrow in width.

Accordingly, it is possible to maximize the size of the tub while the first coupling surface and the second coupling surface for welding are prevented from being interfered with the inner space of the cabinet, and a large washing capacity can be secured. At this time, since the sides of the washing space in which the widths of the first coupling surface and the second coupling surface are relatively narrow in the lateral direction are less liable to leak washing water than the lower side in which the washing water is filled, even if only the main-coupling protrusion is formed, the generation of water leakage can be stably prevented.

In other words, the first and second coupling surfaces on the sides of the washing space in the lateral direction relatively difficult to generate water leakage are formed to be relatively narrow in width, and since only the main-coupling protrusions are formed, it is possible to maximize the size of the tub while securing airtight performance.

Sixth, the second coupling surface is formed with a blocking protrusion which is positioned on the inside of the coupling protrusion in a state where the first coupling surface and the second coupling surface are coupled with each other. Therefore, the flash generated when welding the coupling protrusions can be prevented from flowing into the washing space.

At this time, the blocking protrusion is formed on the second coupling surface facing the first coupling surface on which the coupling protrusion is formed, thereby effectively preventing the flash from being introduced into the washing space while the coupling protrusion is being welded.

In other words, since the end of the coupling protrusion contacting the second coupling surface is melted, the flash is generated on a side of the second coupling surface and accumulated from a side of the second coupling surface in a space between the first coupling surface and the second coupling surface. At this time, since the blocking protrusion also protrudes from the second coupling surface, it is possible to effectively prevent the flash accumulated from the side of the second coupling surface from being introduced into the tub.

Seventh, a guide protrusion for guiding the coupling protrusion to the outside of the blocking protrusion may be formed on the second coupling surface. The guide protrusions are formed on the second coupling on both sides facing each other in the lateral direction with respect to the inner space of the second case. In addition, the guide protrusion is formed with an inclined surface inclined downward from the inside to the outside.

Therefore, the coupling protrusion can be guided accurately to the second coupling surface outside the blocking protrusion to be welded by the inclined surface of the guide protrusion. In other words, the coupling protrusion is guided to the second coupling surface at the correct position by the guide protrusion, so that stable welding can be performed.

In addition, a supporting portion is formed at an outer end portion of the guide protrusion through which the inclined surface ends. Therefore, the coupling protrusion can be supported by the supporting portion in a state of being guided by the second coupling surface on the outside of the blocking protrusion, so that the position thereof can be maintained, and more stable welding can be performed. The coupling protrusion is supported by the supporting portion of the guide protrusion so that the coupling strength between the first case and the second case is further reinforced, and the overall strength of the tub can be reinforced.

DETAILED DESCRIPTION

Hereinafter, specific embodiments of the present invention will be described in detail with reference to the drawings. It should be understood, however, that there is no intention to limit the spirit of the invention to the illustrated embodiment, and that other embodiments falling within the spirit of the invention or another degenerate invention can be easily proposed by addition, change, deletion, or the like.

Figure 1:
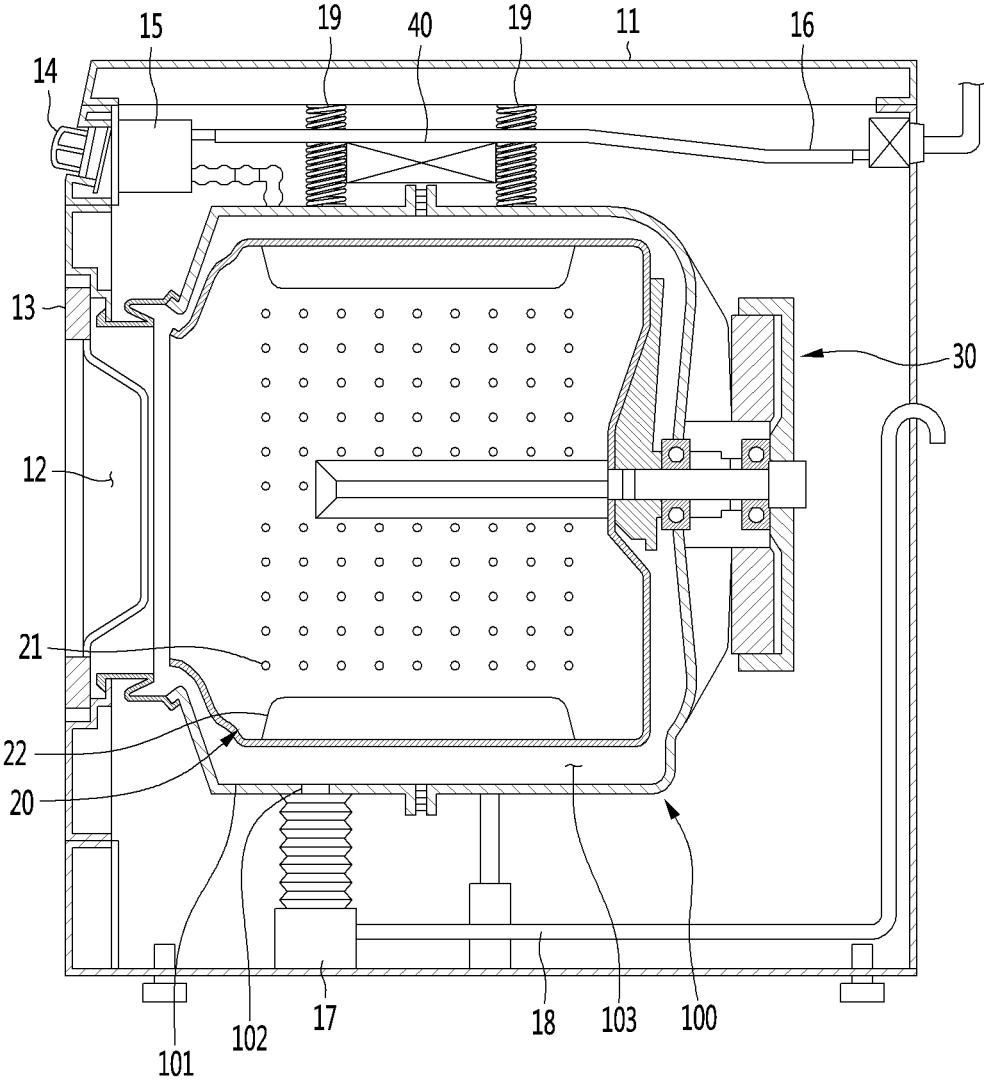
FIG. 1 is a sectional view illustrating an internal structure of a washing machine according to an embodiment of the present invention.
Figure 2:
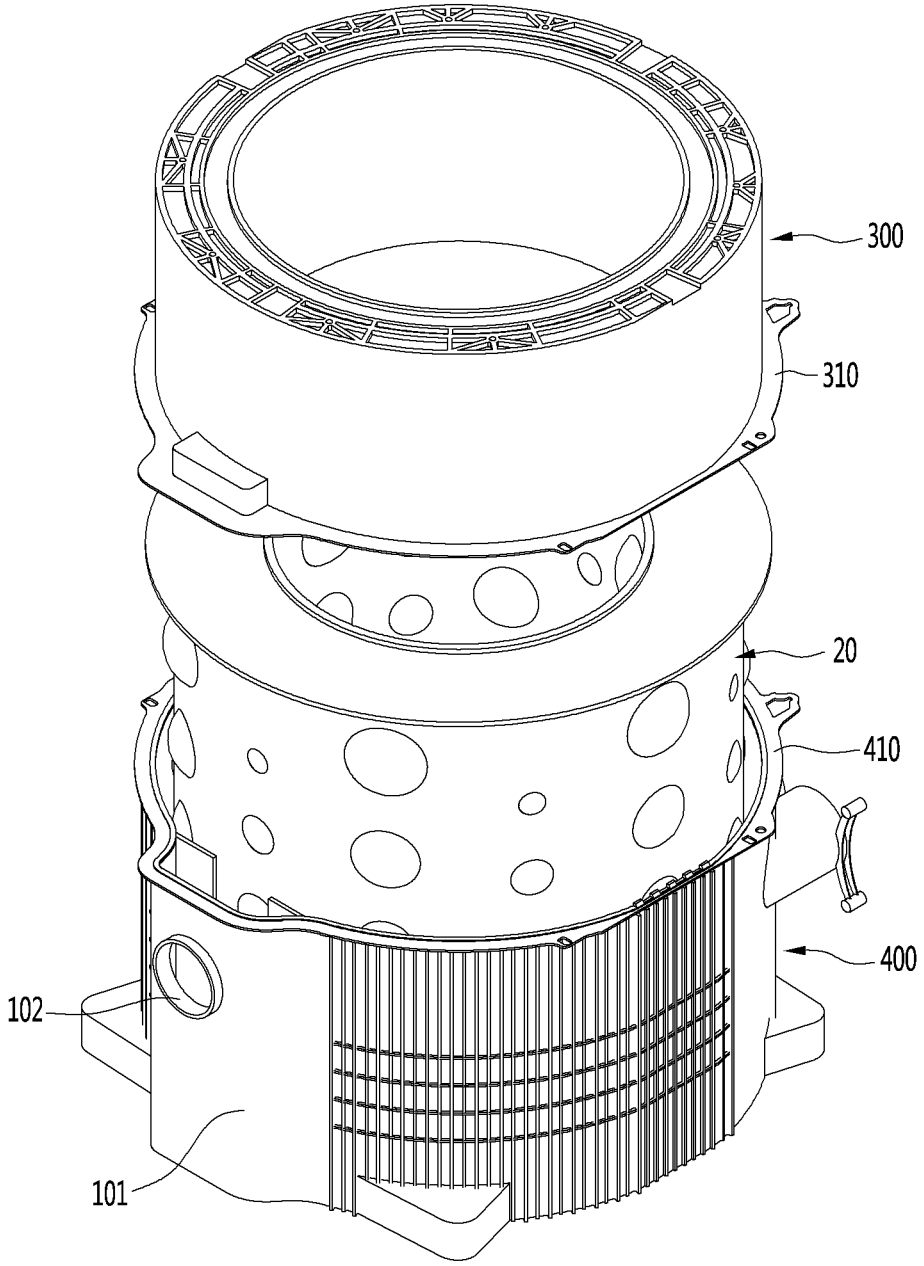
FIG. 2 is a view illustrating a state where a tub is disassembled according to an embodiment of the present invention.

FIG. 1 is a sectional view illustrating an internal structure of a washing machine according to an embodiment of the present invention. In addition, FIG. 2 is a view illustrating a state where a tub is disassembled according to an embodiment of the present invention.

The tub 100 according to the embodiment of the present invention may be applied to a general washing machine provided with a drum having a vertical rotational shaft or to a drum washing machine 1 having a horizontal rotational shaft.

Hereinafter, for example, a state where the tub 100 is provided in the drum washing machine 1 is described.

The drum washing machine 1 may include a cabinet 11 forming an external shape and having a space formed therein. The cabinet 11 may have an entrance 12 through which the laundry may enter and exit on the front surface thereof.

The cabinet 11 may be formed in a substantial box shape.

An operation unit 14 for operating the operation of the drum washing machine 1 may be provided on the front of the cabinet 11.

A detergent box 15 may be provided on the front of the cabinet 11 to enter and exit in the cabinet 11. The user can dispense the detergent into the detergent box 15 by pulling the detergent box 15 out.

The cabinet 11 may be provided with a water supply pipe 16 for supplying washing water into the tub 100. The water supply pipe 16 may be connected to an external water supply source and can extend into the cabinet 11 through the cabinet 11.

The water supply pipe 16 is connected to the tub 100 via the detergent box 15 so that the detergent input to the detergent box 15 can be supplied to the tub 100 together with the washing water.

A drain pump 17 and a drain pipe 18 for circulating or discharging washing water may be provided on the lower side of the tub 100 in the cabinet 11.

The drain pipe 18 is connected to one side of the lower surface of the tub 100 and may extend outside the cabinet 11. The drain pump 17 is connected to the drain pipe 18 to discharge the washing water.

The drum washing machine 1 may include a door 13 for opening and closing the entrance 12. The door 13 may be rotatably installed in the cabinet 11 and may open and close the entrance 12 by the rotation.

The drum washing machine 1 may include the tub 100 which is installed inside the cabinet 11, a drum 20 which is rotatably installed inside the tub 100 and washed with laundry, and a motor 30 which is mounted on the tub 100 to rotate the drum 20.

The tub 100 is formed in a substantially cylindrical shape, and a washing space 103 filled with washing water may be formed therein. The drum 20 may be received in the washing space 103 of the tub 100.

The tub 100 may be provided in the cabinet 11 in a lying form, and the front surface facing the entrance 12 may be opened. The tub 100 may be provided as a structure which is suspended from the cabinet 11 by a spring 19.

A water collection portion 101 for collecting washing water may be formed in the lower portion of the tub 100. The water collection portion 101 is formed as a structure in which the inner bottom surface of the tub 100 is downwardly recessed so that the washing water can be collected easily. A drain port 102 communicating with the drain pipe 18 may be formed in the water collection portion 101 so that washing water can be discharged.

The drum 20 is formed in a substantially cylindrical shape, and a space for receiving laundry therein can be formed. At this time, the drum 20 is formed to be smaller than the washing space 103 of the tub 100, so that the outer surface of the drum 20 may be spaced apart from the inner surface of the tub 100.

The drum 20 may be provided in a lying form in the tub 100 and may be opened toward the entrance 12. Therefore, the laundry can enter and exit the drum 20 through the entrance 12.

A plurality of holes 21 through which washing water can pass may be formed around the drum 20. When the drum 20 rotates, the washing water in the tub 100 may be supplied to the inside of the drum 20 through the holes 21, or the washing water in the drum 20 may be discharged to the outside of the drum 20. In other words, the washing water in the washing space 103 can enter, exit, and is circulated to the inside of the drum 20.

The motor 30 may be provided behind the tub 100. In other words, the motor 30 may be provided on the outside of the rear surface of the tub 100 facing the opened front surface of the tub 100. The rotational shaft of the motor 30 may be connected to the drum 20 through a rear surface of the tub 100.

At this time, the rotational shaft of the motor 30 may be formed horizontally with the ground. In other words, the drum 20 is rotated around a rotational shaft which is parallel to the ground, so that the laundry contained therein can be moved upward and then dropped.

The drum 20 may be provided with a lift 22 for lifting the laundry when the drum 20 rotates. The lift 22 may protrude from the inner circumferential surface of the drum 20. A plurality of lifts 22 may be provided in positions spaced apart from each other along the inner circumferential surface of the drum 20.

When the washing machine 1 is operated for washing, washing water can be supplied to the washing space 103 of the tub 100 through the water supply pipe 16. The washing water supplied into the tub 100 may be filled from the lower portion of the tub 100.

The washing water filled in the tub 100 can be circulated to the inside and the outside of the drum 20 through the holes of the drum 20.

When the washing water is sufficiently supplied into the tub 100, the motor 30 is operated to rotate the drum 20. When the drum 20 is rotated, while dropping after the laundry in the drum 20 is moved upward by the lift 22, washing can be performed by the washing water.

When the washing machine is completed, the motor 30 is stopped and the drain pump 17 can be operated. When the drain pump 17 is operated, the washing water in the tub 100 can be discharged to the outside through the drain port 102 and the drain pipe 18.

Meanwhile, the tub 100 may form an external shape by a combination of a plurality of configurations. In other words, the tub 100 may be configured in a state of being fully received in the drum 20 by a combination of a plurality of divided configurations. The plurality of configurations for forming the external shape of the tub 100 may form a portion of the washing space 103, respectively.

For example, the overall external shape of the tub 100 may be formed by coupling the first case 300 and the second case 400.

The first case 300 and the second case 400 may be injection molded from a plastic material. In addition, the first case 300 and the second case 400 may be coupled to each other by a welding process to form the external shape of the tub 100. At this time, as the welding process, a welding method in which vibration may be generated at the connection portion between the first case 300 and the second case 400, or ultrasonic waves may be irradiated to bond them together can be applied.

The first case 300 may be configured to form approximately half of the cylindrical tub 100. The second case 400 may be configured to form the other half of the cylindrical tub 100.

As illustrated in FIG. 1, the first case 300 can be seen as forming the front half portion of the tub 100, which is positioned close to the front of the cabinet 11 on which the entrance 12 is formed. Therefore, the first case 300 may be referred to as a 'front case'.

The second case 400 may be seen as forming the rear half portion of the tub 100 positioned close to the rear surface of the cabinet 11. Therefore, the second case 400 may be referred to as a 'rear case'.

The first case 300 may be formed in a substantially cylindrical shape to form a portion of the washing space 103. At this time, the first case 300 may be formed into a cylindrical shape opened front and rear.

In other words, the first case 300 may be formed with a front opening so that laundry can enter and exit. In addition, the first case 300 may be formed so that an inner space thereof may be also open at the rear so as to be connected to an inner space formed in the second case 400. In addition, the front half portion of the washing space 103 may be formed by the inner space of the first case 300.

The second case 400 may be formed in a substantially cylindrical shape to form a remaining portion of the washing space 103. The second case 400 may be formed in a cylindrical shape which opens forward. In other words, the second case 400 may have an open front so that the inner space can be connected to the inner space formed in the first case 300. The rear portion of the washing space 103 may be formed by the inner space of the second case 400. An axial through-hole 401 through which the rotary shaft of the motor 30 passes may be formed on a rear surface of the second case 400.

The facing surfaces of the first case 300 and the second case 400 may be formed to correspond to each other. For example, the rear surface of the first case 300 and the front surface of the second case 400 may be coupled to each other.

Accordingly, the first case 300 and the second case 400 may form an external shape of the tub 100 by coupling surfaces facing each other and can form the washing space 103 of the tub 100.

The drum 20 can be inserted into the inner space of the first case 300 and the second case 400 in a state where the first case 300 and the second case 400 are spaced apart from each other. The drum 20 can be coupled with the rotational shaft of the motor 30 through the shaft through-hole 401 of the second case 400. In addition, the drum 20 may be rotatably received in the washing space 103 by the coupling of the first case 300 and the second case 400.

Meanwhile, in the assembled state, the tub 100 may be coupled so that the facing surfaces of the first case 300 and the second case 400 are hermetically coupled so that leakage does not occur. For this purpose, a coupling surface extending vertically outward may be formed on the surfaces of the first case 300 and the second case 400 facing each other.

In detail, a first coupling surface 310 extending vertically outward along the outer periphery of the first case 300 may be formed at a rear end of the first case 300. In other words, at the rear end of the first case 300, a first coupling surface 310 extending vertically outward along the circumference may be formed.

A second coupling surface 410 extending vertically outward along the outer periphery of the second case 400 may be formed on the front of the second case 400. In other words, the second coupling surface 410 may be formed on the front surface of the second case 400 so as to extend vertically outward along the circumference of the front surface.

The first coupling surface 310 and the second coupling surface 410 may have a shape and an area corresponding to each other. The first coupling surface 310 and the second coupling surface 410 may be coupled to each other by a welding process to become a hermetic state.

Hereinafter, the welding structure of the first case 300 and the second case 400 will be described in more detail with reference to the drawings.

Figure 3:
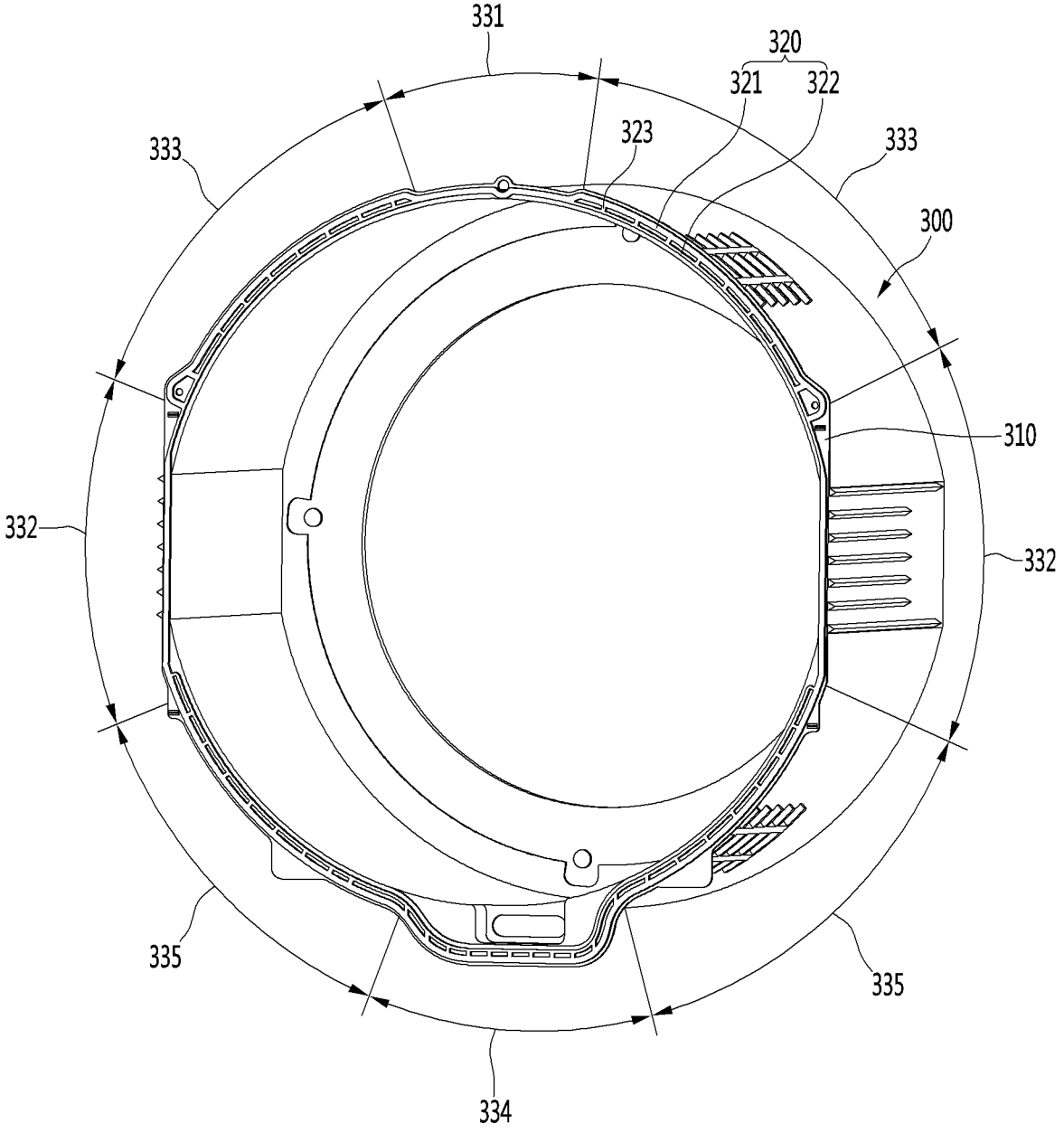
FIG. 3 is a rear perspective view illustrating the first case according to an embodiment of the present invention.
Figure 4:
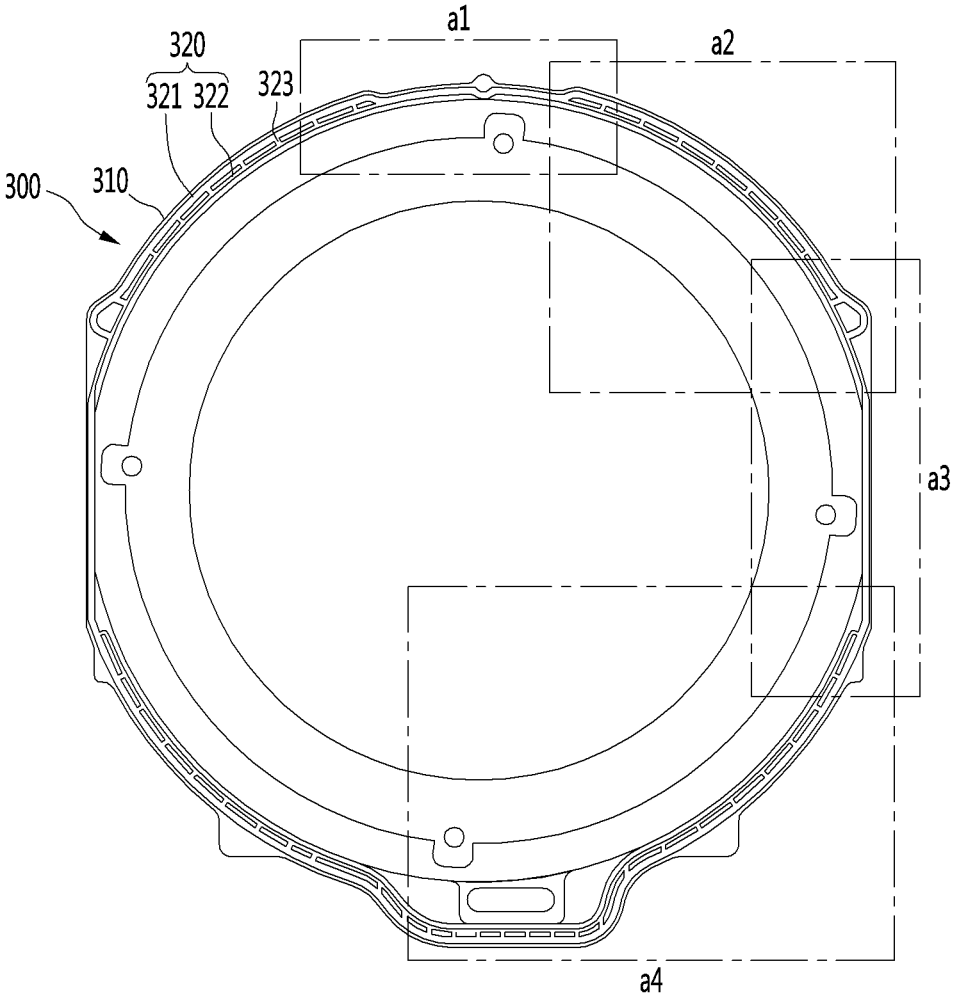
FIG. 4 is a rear view illustrating the first case according to an embodiment of the present invention.
Figure 5:
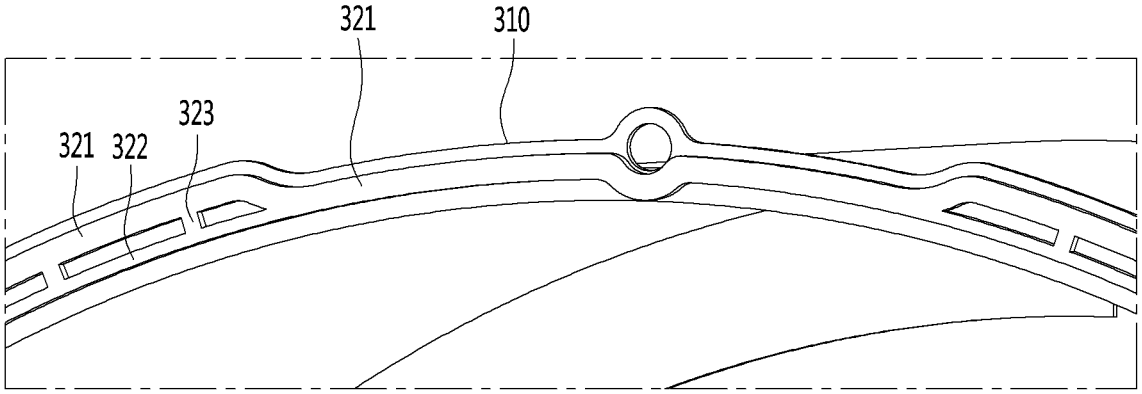
FIG. 5 is an enlarged view of area a1 in FIG. 4.
Figure 6:
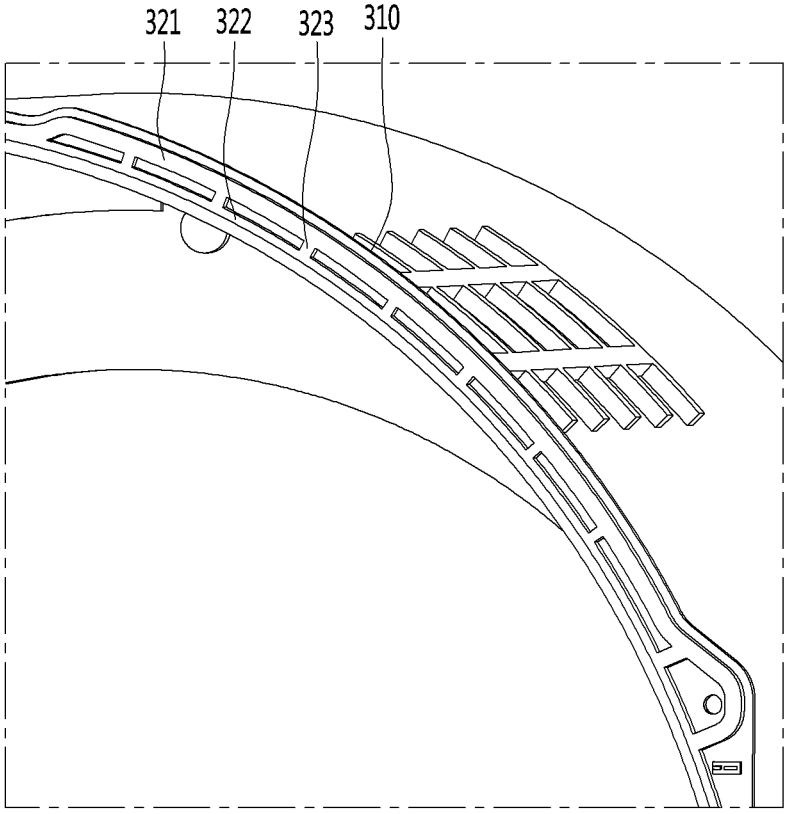
FIG. 6 is an enlarged view illustrating area a2 in FIG. 4.
Figure 7:
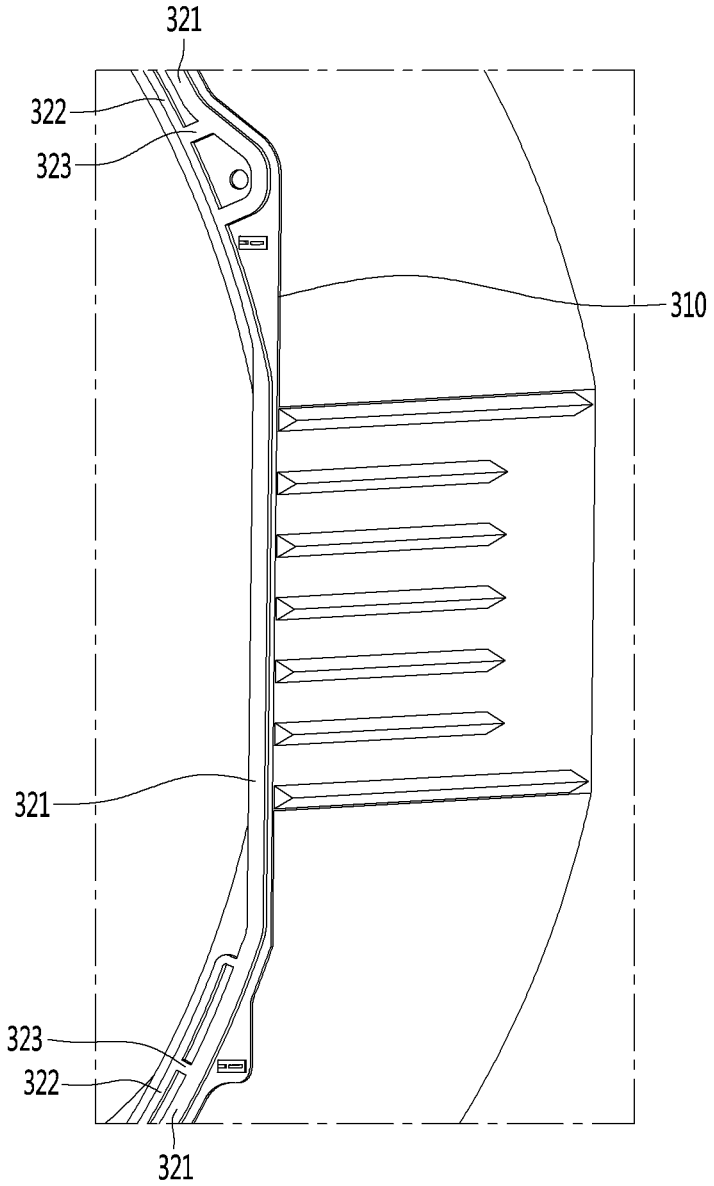
FIG. 7 is an enlarged view illustrating area a3 in FIG. 4.
Figure 8:
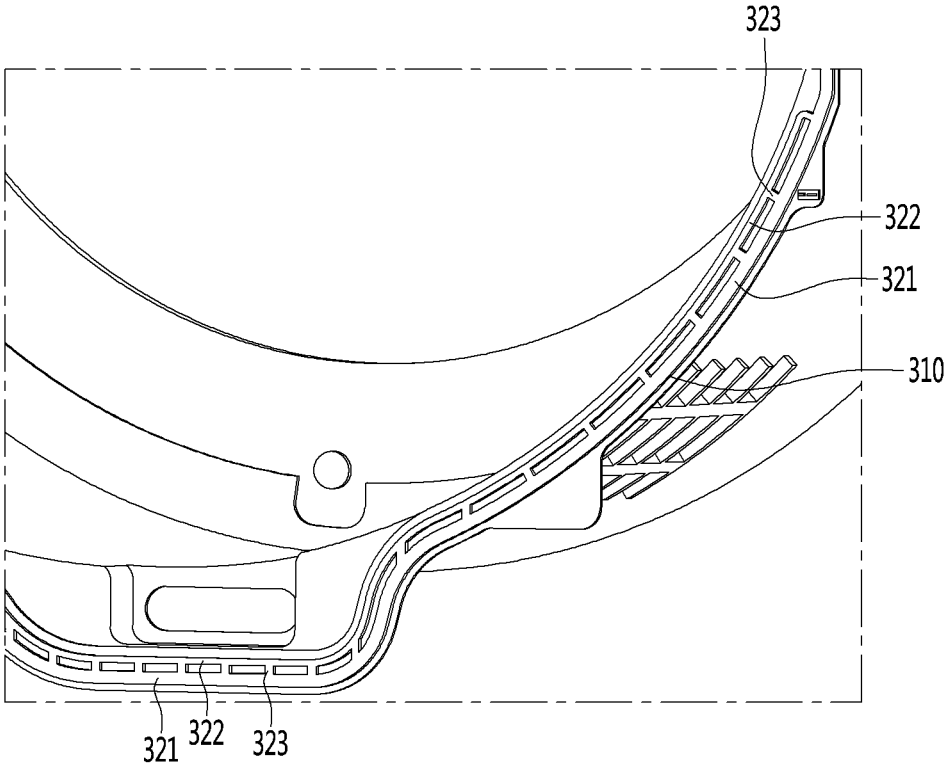
FIG. 8 is an enlarged view illustrating area a4 in FIG. 4.

FIG. 3 is a rear perspective view illustrating the first case according to an embodiment of the present invention. FIG. 4 is a rear view illustrating the first case according to an embodiment of the present invention. FIG. 5 is an enlarged view of area a1 in FIG. 4. FIG. 6 is an enlarged view illustrating area a2 in FIG. 4. FIG. 7 is an enlarged view illustrating area a3 in FIG. 4. FIG. 8 is an enlarged view illustrating area a4 in FIG. 4.

The first coupling surface 310 may be formed on the rear surface of the first case 300.

The coupling protrusion 320 may be formed on the first coupling surface 310.

The coupling protrusion 320 may protrude rearward from the rear surface of the first case 300. In other words, the coupling protrusion 320 may protrude vertically from the first coupling surface 310. The coupling protrusion 320 may include a main-coupling protrusion 321 and a sub-coupling protrusion 322.

The main-coupling protrusion 321 may be thicker than the sub-coupling protrusion 322. The main-coupling protrusion 321 may be formed along the entire circumference of the rear end of the first case 300. The main-coupling protrusion 321 may be formed along the first coupling surface 310 and may be positioned to be spaced inwardly from an outer end portion of the first coupling surface 310.

The first coupling surface 310 may further include the sub-coupling protrusion 322 on the first coupling surface 310. The sub-coupling protrusion 322 may be formed along the first coupling surface 310. At this time, the sub-coupling protrusion 322 is formed along the first coupling surface 310 and may be positioned so as to be spaced apart outside the inner end portion of the first coupling surface 310.

In other words, the first coupling surface 310 is provided with a space on the outside and the inside with respect to the main-coupling protrusions 321 and the sub-coupling protrusions 322, so that a space sufficient to weld the first coupling surface 310 and the second coupling surface 410 can be provided.

The sub-coupling protrusion 322 may be positioned inside the main-coupling protrusion 321 on the first coupling surface 310. In other words, the sub-coupling protrusion 322 may be positioned closer to the inner space of the tub 100 than the main-coupling protrusion 321.

Meanwhile, the first coupling surface 310 may be formed on the entire rear circumference of the first case 300 and may have a different width extending outwardly according to the position. In other words, the first coupling surface 310 may have a partially different area.

In addition, the sub-coupling protrusion 322 may be formed only at a portion of the first coupling surface 310. The sub-coupling protrusion 322 is formed at a portion of the first coupling surface 310 providing a width in which both the main-coupling protrusion 321 and sub-coupling protrusion 322 can be disposed, and only the main-coupling protrusion 321 may be formed at a position where the width of the surface 310 is narrow and both main-coupling protrusion 321 and sub-coupling protrusion 322 cannot be formed.

In detail, the main-coupling protrusion 321 is formed entirely along the first coupling surface 310 so as to surround the washing space 103, and the sub-coupling protrusion 322 may be partially formed in a portion section along the first coupling surface 310. The sub-coupling protrusion 322 may be formed only in a wide width area of the first coupling surface 310.

The drum washing machine 1 may have a vertical height longer than a lateral width. In other words, the cabinet 11 may have a vertical height longer than a lateral width. Therefore, the internal space of the cabinet 11 may be formed longer than the lateral widths.

Therefore, a space in which the water supply pipe 16 extends and a space in which the spring 19 is provided can be secured in a space above the tub 100 in the cabinet 11. The space below the tub 100 in the cabinet 11 may be provided with a space in which the drain pump 17, the drain pipe 18, or the like is provided.

Since the internal space of the cabinet 11 can be formed to be longer vertically than the lateral widths of the cabinets 11, the clearance space above and below the lateral sides of the tub 100 can be further secured in the cabinets 11.

The tub 100 has an outer diameter corresponding to the width of the inner space of the cabinet 11 in the lateral direction so that the inner space of the cabinet 11 can be maximally utilized to maximize the washing space 103. In other words, the diameter of the section of the tub 100 may be approximately the same as the width of the inner space of the cabinet 11 in the lateral direction.

Accordingly, the washing space 103 of the tub 100 can be maximally secured, and the size of the drum 20 can be secured as much as possible to effectively secure the washing capacity.

Meanwhile, in a state where the washing space 103 is formed as large as possible, the inner space of the cabinet 11 is relatively narrower in a lateral space than the spaces above and below the tub 100. Therefore, the outer diameter of the tub may be determined with respect to the length of the washing space 103 in the lateral direction. The first and second coupling surfaces 310 and 410 may be narrowed at positions corresponding to the lateral sides of the tub 100 to maximize the washing space 103.

In other words, the first coupling surface 310 and the second coupling surface 410 of the tub 100 protrude outward the circumferential surface of the tub 100, and the extended length of the portions protruding from the lateral sides can be shorter than the other portion. In other words, the first and second coupling surfaces 310 and 410 may be formed to have relatively narrow widths protruding from the lateral sides of the tub 100.

A portion of both sides of the tub 100 in the lateral direction may be formed to have a straight section parallel to the inner surface of the cabinet 11. In other words, the section of the tub 100 may be formed in a straight shape on both sides of the tub in the lateral direction, rather than in a round shape. Such a structure is a structure for maximizing the size of the washing space 103 in the washing space 103 having a limited width on both sides in the lateral direction. A portion where the width of the first coupling surface 310 and the second coupling surface 410 is narrow may be formed in the straight section of the tub 100. Both sides of the first coupling surface 310 and the second coupling surface 410 in the lateral direction formed in the straight section of the first case 300 and the second case 400 may also be formed in a straight shape.

The first coupling surface 310 formed on the lateral sides of the first case 300 is formed to have a relatively narrow width so that an area for forming the main-coupling protrusion 321 and the sub-coupling protrusion 322 together may be difficult to secure. Therefore, only the main-coupling protrusion 321 may be formed on the first coupling surface 310 formed on the lateral sides of the first case 300.

Meanwhile, a predetermined space may be formed above the tub 100 in the cabinet 10. In the space above the tub 100, various auxiliary devices 40 may be further provided to assist washing or drying of laundry.

For example, the upper portion of the tub 100 may have an opening through which air is introduced or discharged into the tub 100. The auxiliary device 40 may be a duct device for drying or heating the air introduced into the tub 100. Alternatively, the auxiliary device 40 may be a heater connected to the water supply plate 16 passing through the upper space of the tub 100 and heating the washing water supplied into the tub 100.

Meanwhile, the extension length can be limited so that a portion section of the upper portion of the tub 100 corresponding to the abutting position of the auxiliary device 40 among the first and second coupling surfaces 310 and 410 may be prevented from being interfered with the auxiliary device 40 So that. In other words, the first coupling surface 310 formed on the upper portion of the first case 300 and the second coupling surface 410 formed on the upper portion of the second case 400 may have a relatively narrow width.

Therefore, only the main-coupling protrusion 321 may be formed on the first coupling surface 310 formed on the upper portion of the first case 300.

The sub-coupling protrusion 322 may be formed in the remaining region of the first coupling surface 310 excluding the first coupling surface 310 formed on the upper portion of the first case 300 and the first coupling surface 310 formed on the lateral portions of the first case 300.

In other words, as illustrated in FIG. 4, when the rear surface of the first case 300 is viewed from the front, the sub-coupling protrusions 322 may be formed on both lateral diagonal portions excluding the upper-end of the first case 300 of the lower space of the first case 300 and the upper space of the first space excluding both side ends of the first case 300 in the lateral direction.

In addition, since the width of the first coupling surface 310 is relatively narrow at the lateral portions and the upper portion of the first case 300, the sub-coupling protrusion 322 is not formed. In other words, the sub-coupling protrusions 322 is formed along the first coupling surface 310, but are formed in a state of being broken at portions corresponding to the lateral ends and the upper-end of the tub 100. In addition, the broken end portion of the sub-coupling protrusion 322 may be connected to the main-coupling protrusion 321.

Meanwhile, the connection rib 323 may be formed on the first coupling surface 310 in a region where the main-coupling protrusion 321 and the sub-coupling protrusion 322 are formed together. The connection rib 323 may protrude to space which is spaced apart between the main-coupling protrusion 321 and the sub-coupling protrusion 322. The connection rib 323 may be formed to connect the main-coupling protrusion 321 and the sub-coupling protrusion 322.

A plurality of connection ribs 323 may be formed between the main-coupling protrusions 321 and the sub-coupling protrusions 322. The plurality of connection ribs 323 may be spaced apart from each other along the circumference of the rear surface of the first case 300. Both ends of the connection ribs 323 are connected to the main-coupling protrusion 321 and the sub-coupling protrusion 322, respectively, and the connection ribs 323 may extend in a direction intersecting with the main-coupling protrusion 321 and the sub-coupling protrusion 322.

Therefore, the main-coupling protrusion 321 and the sub-coupling protrusion 322 are mutually supported by the connection rib 323 so that the strength can be reinforced. Therefore, it is possible to prevent the main-coupling protrusion 321 and the sub-coupling protrusion 322 from being folded or broken during an external shock or welding process.

Meanwhile, the lower space of the washing space 103 forms a portion where washing water is collected. Particularly, a recessed collection space is formed at the lower end of the tub, so that the lower end of the tub 100 should be coupled in a more airtight state. Therefore, more stable welding may be required in the lower portion of the first case 300 and the second case 400 corresponding to the lower end of the tub 100.

For this, the plurality of connection ribs 323 may be disposed more densely in a state where the spaced distance is narrow in the lower portion of the first case 300. Therefore, the strength of the main-coupling protrusion 321 and the sub-coupling protrusion 322 in the lower portion of the first case 300 may be higher. When the first case 300 and the second case 400 are welded, the main-coupling protrusions 321 and the sub-coupling protrusions 322 at the lower portion of the first case 300 are more stably welded.

Meanwhile, referring to FIG. 3, it can be defined for each section according to a state of the coupling protrusions 321 and 322 disposed around the first coupling surface 310 formed in the first case 300.

The upper-end of the first case 300 has an upper-end section formed with only the main-coupling protrusion 321. In addition, a side-end section is formed at both side ends of the first case 300 in the lateral direction so that only the main-coupling protrusion 321 is formed. An upper diagonal section is formed on both sides of the upper-end section in the lateral direction, that is, between the upper-end section and the side-end section on which both the main-coupling protrusion 321 and the sub-coupling protrusion 322 are formed. The main-coupling protrusion 321 and the sub-coupling protrusion 322 are formed at the lower end of the first case 300 and a lower end section in which the connection ribs 323 are densely disposed is formed. A lower diagonal section having both the main-coupling protrusion 321 and the sub-coupling protrusion 322 may be formed both lateral sides, that is, between the lower end section and the lower end section of the lower end section.

Meanwhile, since the upper-end section and the side-end section have a structure in which only the main-coupling protrusion 321 is formed on the first coupling surface 310 having a relatively narrow width, the upper-end section and the side-end section may be called as a single coupling section. Since the upper diagonal section, the lower diagonal section, and the lower end section have a structure in which both the main-coupling protrusion 321 and the sub-coupling protrusion 322 are formed on the first coupling surface 310 having a relatively larger width, the upper diagonal section, the lower diagonal section, and the lower end section can be called as a double coupling section.

The second coupling surfaces 410 of the second case 400 coupled to the first coupling surfaces 310 may be formed to have the same width as the first coupling surface 310 and thus can be welded together in a state of overlapping.

Figure 9:
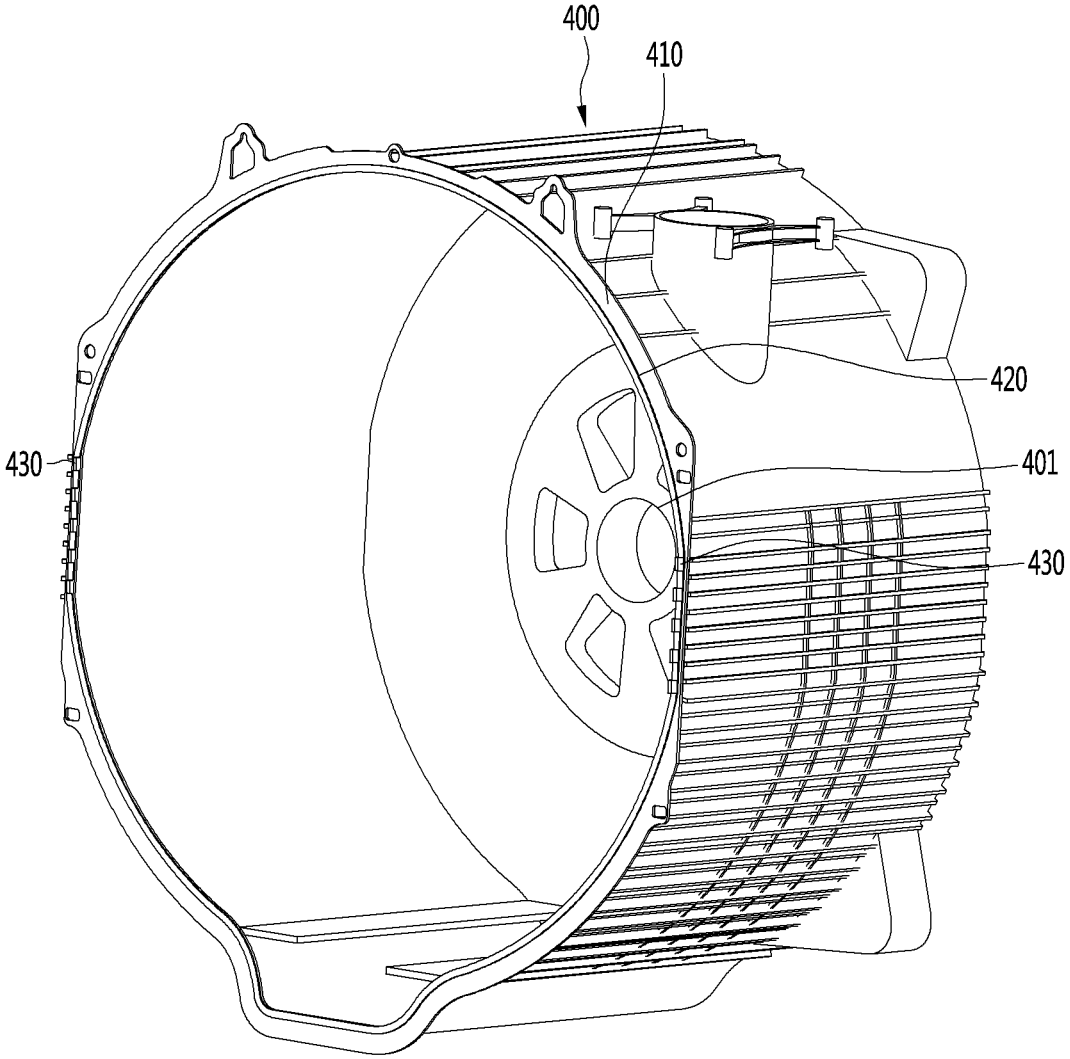
FIG. 9 is a front perspective view illustrating a second case according to an embodiment of the present invention.
Figure 10:
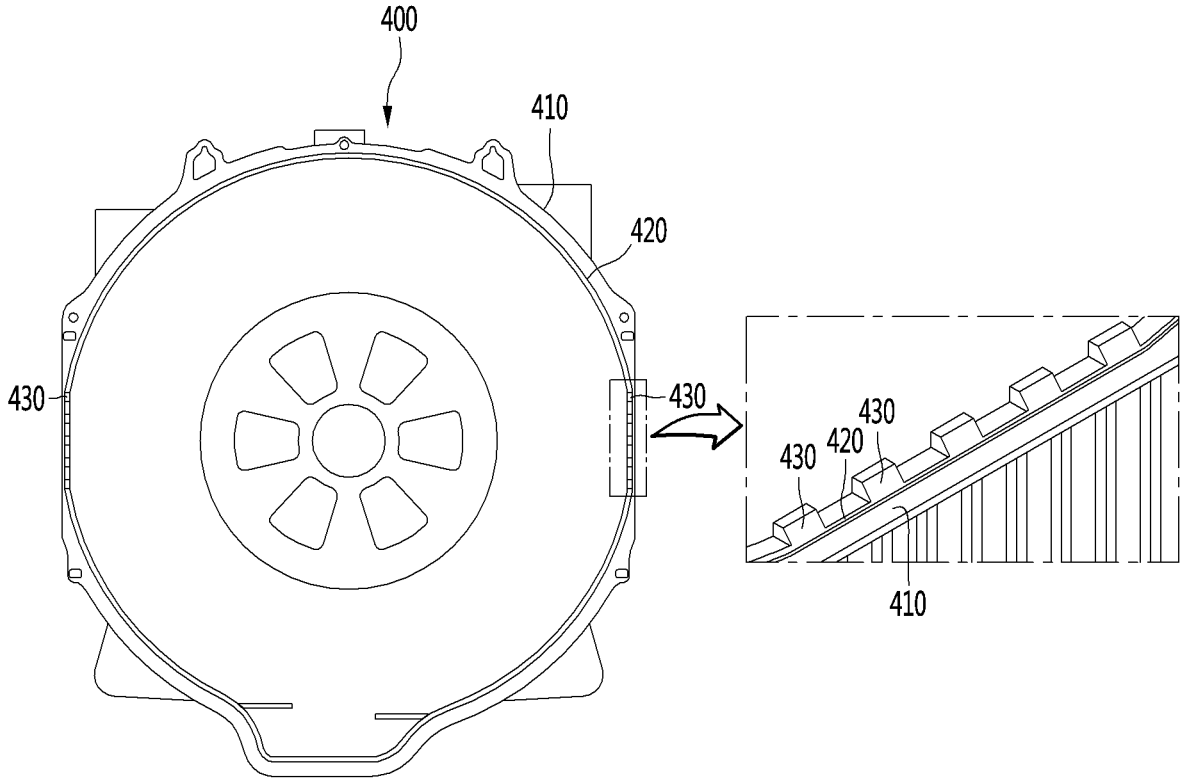
FIG. 10 is a front view illustrating a second case according to an embodiment of the present invention.

FIG. 9 is a front perspective view illustrating a second case according to an embodiment of the present invention. FIG. 10 is a front view illustrating a second case according to an embodiment of the present invention.

The second case 400 may be formed in a cylindrical shape which opens forward. In addition, the through-hole 401 through which the rotational shaft of the motor 30 passes may be formed on the rear surface of the second case 400. The second coupling surface 410 may be formed on the front surface of the second case 400.

The second coupling surface 410 may have a shape and an area corresponding to the first coupling surface 310. The second coupling surface 410 may provide a surface on which the main-coupling protrusion 321 and the sub-coupling protrusion 322 are welded.

Specifically, the main-coupling protrusion 321 and the sub-coupling protrusion 322 can be in contact with the second coupling surface 410 during the welding process of the first case 300 and the second case 400. The main-coupling protrusion 321 and the sub-coupling protrusion 322 rub against the second coupling surface 410 to be melted by the vibration generated by the welding apparatus 500 (FIG. 12) can be welded to the coupling surface 410. The welding apparatus may be, for example, a vibration welder or an ultrasonic welder.

Meanwhile, the connection ribs 323 may protrude to a height equal to the height of the coupling protrusions 320 before welding and when the coupling protrusions 320 are welded to the second coupling surface 410, the connection rib can be welded together with the coupling protrusion 320. In other words, the connection rib 323 is also in contact with the second coupling surface 410 together with the coupling protrusion 320, is melted by the friction with the second coupling surface 410, and can be welded to the second coupling surface 410. Therefore, the first case 300 and the second case 400 can be more firmly coupled by the connection rib 323.

Meanwhile, a blocking protrusion 420 may be formed on the second coupling surface 410. The blocking protrusions 420 protrude along the second coupling surface 410 and may be continuously formed to be formed in a ring shape as a whole.

The blocking protrusion 420 may provide a function of preventing the flash F (FIG. 12) generated when the coupling protrusion 320 is welded to the second coupling surface 410 from flowing into the inside of the tub 100. This will be described in more detail in the description with reference to FIG. 12. The blocking protrusion 420 may reinforce the strength of the second coupling surface 410.

The blocking protrusion 420 may be formed along the circumference of the opened front surface of the second case 400 and protrude forward. In other words, the blocking protrusion 420 may protrude vertically from the second coupling surface 410.

The blocking protrusion 420 may be formed to be thinner than the width of the second coupling surface 410. The blocking protrusion 420 may be formed along an inner end portion of the second coupling surface 410 adjacent to the washing space 103. The blocking protrusion 420 may be formed along the eccentric position of the second coupling surface 410 toward the inner end portion adjacent to the washing space 103. Therefore, the second coupling surface 410 can secure an area where the coupling protrusion 320 can be welded to the outside of the blocking protrusion 420.

Meanwhile, a guide protrusion 430 may be further formed on the second coupling surface 410. The guide protrusions 430 guide so that the first coupling surface 310 and the second coupling surface 410 abut on each other for welding at the correct positions when the first case 300 and the second case are 400 are coupled with each other. A plurality of the guide protrusions 430 may be disposed at regular intervals along the second coupling surface 410. The plurality of guide protrusions 430 may be partially disposed along the second coupling surface 410.

More specifically, the guide protrusion 430 may be formed on the second coupling surface 410 formed at the lateral portions of the second case 400. Alternatively, the guide protrusion 430 may be formed on the second coupling surface 410 formed at the upper and lower portions of the second case 400. The guide protrusion 430 is formed in the area of the second coupling surface 410 that is symmetrical with respect to the inner space of the second case 400 and can be aligned with each other when the first case 300 and the second case 400 are coupled.

Hereinafter, a state where the guide protrusion 430 is formed on the second coupling surface 410 formed on both sides of the second case 400 in the lateral direction will be described as an example. At this time, the position where the guide protrusion 430 is formed can correspond to the side-end section of the first case 300.

A plurality of guide protrusions 430 may be provided on the second coupling surfaces 410 of the lateral portions of the second case 400. At this time, the plurality of guide protrusions 430 may be disposed apart from each other along the inner end portion of the second coupling surface 410 on the lateral sides.

The guide protrusion 430 may have a thickness smaller than the width of the second coupling surface 410. Therefore, an area where the coupling protrusion 320 is welded to the second coupling surface 410 outside the guide protrusion 430 can be secured.

The guide protrusion 430 may include an inclined surface that is inclined downward from the inner end portion of the second coupling surface 410 toward the outside. The guide protrusion 430 may be formed so that the height protruding toward the outside from the inner end portion of the second coupling surface 410 is reduced.

In addition, a vertical supporting portion 431 may be formed at the outer end portion of the guide protrusion 430. The supporting portion 431 extends from the lower end of the inclined surface to the second coupling surface 410 and forms a surface perpendicular to the second coupling surface 410.

The guide protrusion 430 may provide a function of guiding a position where the first case 300 is coupled to the second case 400. The guide protrusion 430 may strengthen the coupling strength between the first case 300 and the second case 400 to prevent the tub 100 from being deformed.

Specifically, when the first coupling surface 310 and the second coupling surface 410 are positioned so as to face each other so as to weld the first case 300 and the second case 400, the coupling protrusion 320 can be guided to the correct position of the second coupling surface 410 to be welded by moving along the inclined surface of the guide protrusion 430. In other words, the coupling protrusion 320 may be guided to the second coupling surface 410 outside the guide protrusion 430 by the inclined surface.

The inner surface of the coupling protrusion 320 is supported on the supporting portion 431 of the guide protrusion 430 so that the coupling protrusion 320 can maintain an accurate position for welding. Therefore, the coupling protrusion 320 can be stably welded to the correct position of the second coupling surface 410.

By supporting the inner surface of the coupling protrusion 320 on the guide protrusion 430, the coupling strength of the tub 100 can be reinforced and deformation of the tub 100 can be prevented.

Meanwhile, the plurality of guide protrusions 430 spaced from each other may be connected by the blocking protrusion 420. In other words, both the blocking protrusion 420 and the guide protrusion 430 may be disposed along the inner end portion of the second coupling surface 410 to overlap with the guide protrusion 430. At this time, the blocking protrusions 420 may be formed to connect the plurality of guide protrusions 430 in a space between the plurality of guide protrusions 430.

The thickness of the blocking protrusion 420 may be smaller than the thickness of the guide protrusion 430. The outer surface of the blocking protrusion 420 may be positioned so as to be connected to the supporting portion 431 of the guide protrusion 430.

Figure 11:
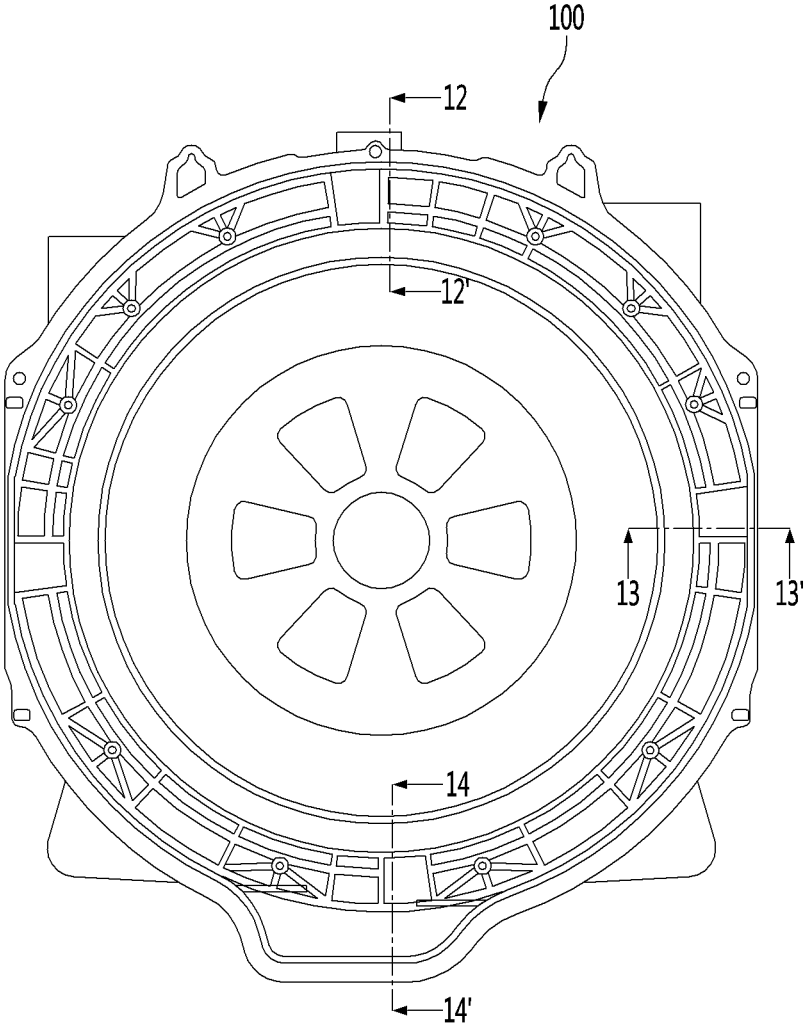
FIG. 11 is a rear view illustrating the tub according to an embodiment of the present invention.
Figure 12:
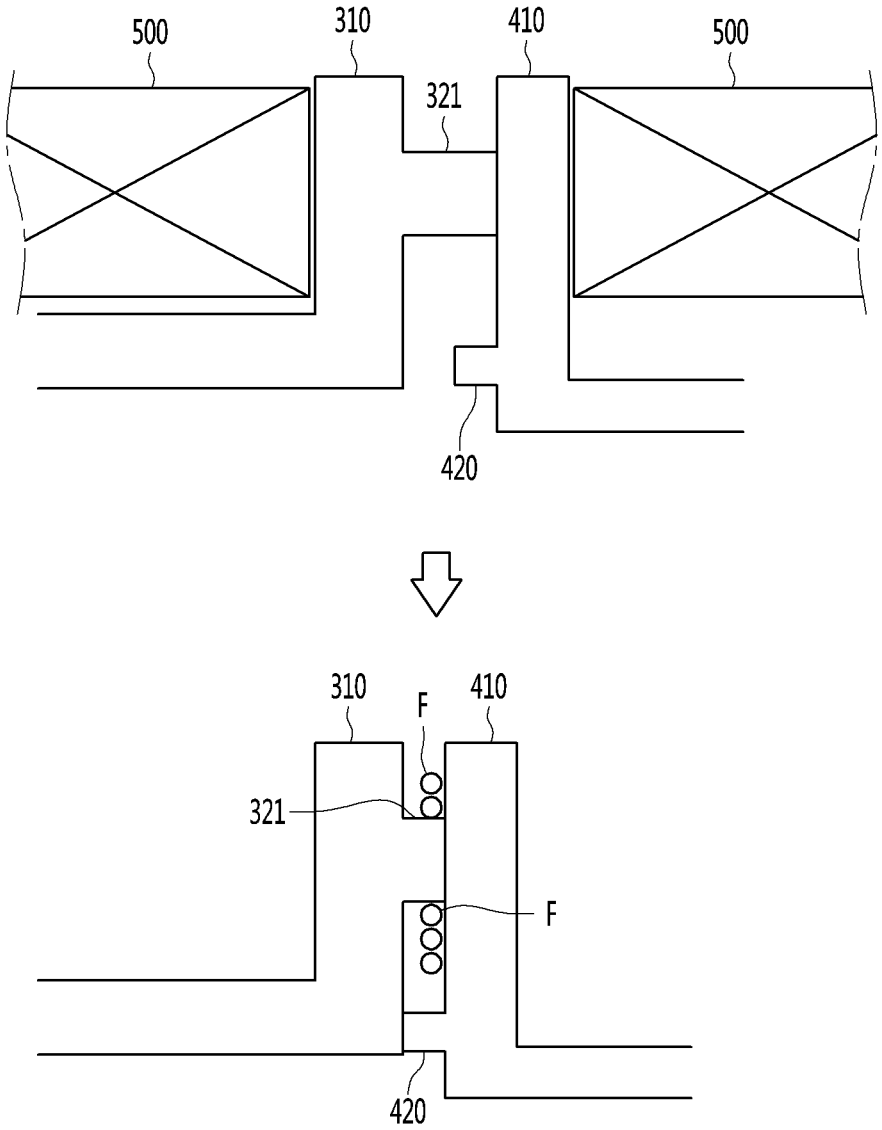
FIG. 12 is a view illustrating the welding structure of the upper portion of the tub by cutting the tub with reference to 12-12' of FIG. 11.

FIG. 11 is a rear view illustrating the tub according to an embodiment of the present invention. FIG. 12 is a view illustrating the welding structure of the upper portion of the tub by cutting the tub with reference to 12-12' of FIG. 11.

The welding structure illustrated in FIG. 12 is not limited to the welding structure on the upper portion of the tub 100, and the same welding structure can be provided in a single coupling section in which the main-coupling protrusion 321 is formed on the first coupling surface 310 and the blocking protrusion 420 is formed on the second coupling surface 410.

Hereinafter, referring to FIG. 12, the welding structure of the region where the main-coupling protrusion 321 is formed on the first coupling surface 310 and the blocking protrusion 420 is formed on the second coupling surface 410 is described in detail.

The first coupling surface 310 and the second coupling surface 410 may be coupled to each other such that the coupling protrusion 320 is welded to the second coupling surface 410 by a welding process.

The vibration may be generated on the first coupling surface and/or the second coupling surface for the welding process so that the coupling protrusions and the blocking protrusions are respectively welded to the second coupling surface and the first coupling surface.

Various welding methods such as ultrasonic welding and vibration welding can be applied to the welding process.

The ultrasonic welding is a welding method in which vertical vibration is supplied to a component using an ultrasonic welding apparatus which generates ultrasonic waves, and the two contact components rub by vibration. The ultrasonic welding is a well-known welding method, and a detailed description of the ultrasonic welding method will be omitted.

The vibration welding is a welding method in which a horizontal vibration is supplied to a component using a vibration device that generates vibration, the two contact components rub by vibration, and thus are welded. The vibration welding is a well-known welding method, and a detailed description of the vibration welding method will be omitted.

For welding, the first case 300 and the second case 400 may be aligned such that the first coupling surface 310 and second coupling surface 410 face each other.

The main-coupling protrusion 321 can be in contact with the protruding end of the second coupling surface 410 in a state where the first coupling surface 310 and the second coupling surface 410 are aligned to face each other.

The welding apparatus 500 may be disposed outside the first coupling surface 310 and the second coupling surface 410 in a state where the main-coupling protrusion 321 is in contact with the second coupling surface 410. The protruding end portion of the main-coupling protrusion 321 may be in close contact with the second coupling surface 410.

In a state where the main coupling protrusion 321 is in close contact with the second coupling surface 410, the vibration is supplied by the welding apparatus 500 and, a frictional heat may be generated at the contact portion between the main coupling protrusion 321 and the second coupling surface 410 by vibration. The main-coupling protrusion 321 may be melted and be welded to the second coupling surface 410 by the frictional heat.

Meanwhile, during the welding process, flash F may occur during the process of solidifying the coupling protrusions 320 after being melted. The flash F may be generated in the form of small particles such as molten raw materials of the coupling protrusions 320, such as agglomerated foreign matter or debris.

The flash F may be generated inside and outside the coupling protrusion 320 during the welding process. The flash F generated from the outside of the coupling protrusion 320 may escape to the outside of the tub 100 through the space between the first coupling surface 310 and the second coupling surface 410. At this time, the flash F generated from the outside of the coupling protrusion 320 may be fixed to and remain in the space between the first coupling surface 310 and the second coupling surface 410, but blocks by the coupling protrusion 320 so as not to flow into the inside of the tub 100.

Meanwhile, a problem that the flash F generated inside the coupling protrusion 320 flows into the inside of the tub 100 through the space between the first coupling surface 310 and the second coupling surface 410 may be also generated. A separate operation for removing the flash F is required in a case where the flash F is introduced into the tub, so that the manufacturing time and manufacturing cost of the tub 100 can be increased. In addition, the flash F may remain inside the tub 100 even if the work for removing the flash F which has flowed into the inside of the tub 100 is performed.

Meanwhile, in the embodiment of the present invention, the blocking protrusion 420 is provided to prevent the flash F from flowing into the tub 100 during the welding process.

In detail, when the first case 300 and the second case 400 are coupled, the blocking protrusions 420 may be positioned further inside than the coupling protrusions 320, may be positioned so as to be spaced apart from the coupling protrusions 320 to the inside thereof.

In other words, the blocking protrusion 420 may be positioned closer to the washing space 103 of the tub 100 than the main-coupling protrusion 321 and the sub-coupling protrusion 322. Therefore, a space for receiving the flash F may be formed between the coupling protrusion 320 and the blocking protrusion 420.

At this time, the inner surface of the blocking protrusion 420 may be positioned on the same extension line as the circumferential surface of the inner space of the first case 300. Therefore, when the first case 300 and the second case 400 are coupled, the blocking protrusion 420 may not protrude into the washing space 103 of the tub 100 and thus it is possible to disturb the flow of washing water inside the tub 100 or to prevent the drum 20 from interfering with the flow of washing water inside the tub 100.

In addition, the blocking protrusion 420 may be formed to have a lower protruding height than the coupling protrusion 320. For example, the blocking protrusion 420 may protrude to a height corresponding to a lowered height by melting the coupling protrusion 320 by a welding process.

When the first coupling surface 310 and the second coupling surface 410 are coupled with each other, the welding of the coupling protrusion 320 having a high protruding height is first performed, and at this time, the flash F may be generated on the coupling protrusion 320. In addition, the blocking protrusions are not welded until welding of the coupling protrusions 420 is completed, and flash F is not generated in the blocking protrusion 420. The blocking protrusion 420 may form a closed space in which the end portion of the blocking protrusion 420 is supported in contact with the first coupling surface 310 when the coupling protrusion 320 is welded and the flash F is received.

Of course, if necessary, the blocking protrusion 420 may be welded to the first coupling surface 310 immediately before the coupling protrusion is completely welded, and may be welded for a short time such that the flash F is not generated.

Accordingly, the protruding end of the blocking protrusion 420 may be adjacent to or in contact with the first coupling surface 410 in a case where the first case 300 and the second case 400 are completely welded. In addition, the flash F is received in a space between the coupling protrusion 320 and the blocking protrusion 420 so that the flash F can be effectively prevented from flowing the inside of the tub 100.

In other words, referring to FIG. 12, the flash F generated inside the main-coupling protrusion 321 is restrained in a space between the main-coupling protrusion 321 and the blocking protrusion 420 so that the flash F does not flow into the tub 100.

Meanwhile, the main-coupling protrusion 321 may be positioned substantially at the center of the width of the first coupling surface 310. Therefore, vibration can be effectively transmitted by the welding apparatus 500, and welding can be stably performed.

Figure 13:
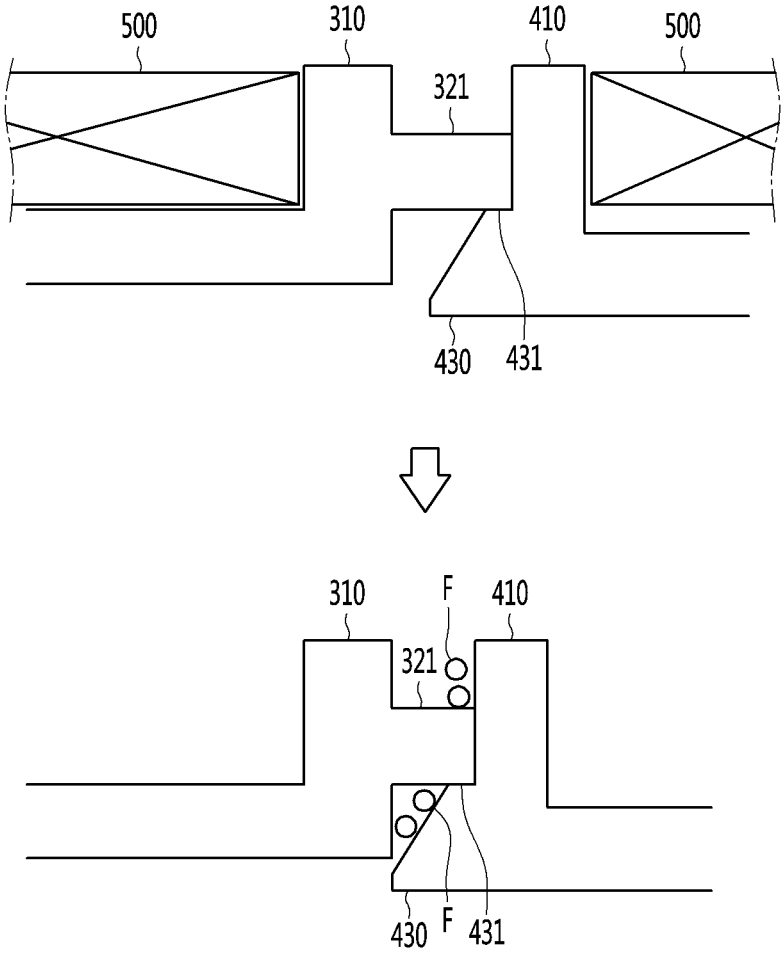
FIG. 13 is a view illustrating the welding structure of the side portions of the tub in the lateral direction by cutting the tub with reference to 13-13' of FIG. 11.

FIG. 13 is a view illustrating the welding structure of the side portions of the tub in the lateral direction by cutting the tub with reference to 13-13' of FIG. 11.

The welding structure illustrated in FIG. 13 is not limited to the welding structure of the left side portion or the right side portion of the tub 100 and relates to a welding structure in which only the main-coupling protrusion 321 is formed on the first coupling surface 310, and a guide protrusion 430 and a blocking protrusion 420 are formed on the coupling surface 410.

Hereinafter, referring to FIG. 13, a welding structure of a region in which a main-coupling protrusion 321 is formed on the first coupling surface 310 and a guide protrusion 430 and a blocking protrusion 420 are formed on the second coupling surface 410 will be described in detail.

When the coupling protrusion 320 of the first coupling surface 310 is aligned with the second coupling surface 410 for welding, the coupling protrusion 320 is moved along the inclined surface of the guide protrusion 430 and can be guided to the correct position on the second coupling surface 410.

For example, in a case where the first coupling surface 310 and the second coupling surface 410 are misaligned or deformed, the main-coupling protrusion 321 can be in contact with the inclination of the guide protrusion 430. The main-coupling protrusion 321 may be moved outward along the inclination of the guide protrusion 430 to be guided to the second coupling surface 410 outside the guide protrusion 430 to be welded.

In addition, in a case where the protruding end portion of the main-coupling protrusion 321 is in contact with the second coupling surface 410, the inner surface of the main-coupling protrusion 321 is in contact with the supporting portion 431 of the guide protrusion 430, does not flow inward or outward, and thus an accurate welding position thereof can be maintained.

The coupling protrusion 320 of the region where the guide protrusion 430 is not formed is also aligned and maintained at a correct position of the second coupling surface 410 to be welded, as the welding position of the coupling protrusion 320 is aligned and maintained in a region in which the guide protrusion 430 is formed.

Meanwhile, also in the region where the guide protrusion 430 is formed, the flash F generated during welding can be generated inside and outside the coupling protrusion 320. The flash F generated from the outside of the main-coupling protrusion 321 can escape to the outside of the tub 100 through the space between the first coupling surface 310 and the second coupling surface 410.

In addition, the flash F generated inside the main-coupling protrusion 321 may be restrained in a space between the guide protrusion 430 and the main-coupling protrusion 321. In other words, the flash F is restrained between the main-coupling protrusion 321 and the inclined surface of the guide protrusion 430 and thus can be prevented from entering the inside of the tub 100.

For this, the guide protrusion 430 may be formed to have a height corresponding to a height of the coupling protrusion 320 which is melted by the welding process and is lowered. Accordingly, the protruding end portion of the guide protrusion 430 may be adjacent to or in contact with the first coupling surface 410 in a state where the welding coupling of the first case 300 and the second case 400 is completed. Therefore, the flash F can be received in the space between the coupling protrusion 320 and the guide protrusion 430, and the flash F can be prevented from entering the inside of the tub 100.

The guide protrusion 430 may be formed to have a height higher than the height of the coupling protrusion 320 when the coupling protrusion 320 is melted by the welding process. In this case, the inner end of the guide protrusion 430 protruding to the maximum can be positioned inside the circumference of the inner space of the first case 300. In a state where the first case 300 and the second case 400 are completely welded to each other, the inclined surfaces of the guide protrusions 430 may be adjacent to the inner end portion of the first coupling surface 310. Even in this case, the flash F can be stably restrained in the space between the coupling protrusion 320 and the guide protrusion 430.

Meanwhile, the main-coupling protrusion 321 may be positioned substantially at the center of the width of the first coupling surface 310. Therefore, vibration can be effectively transmitted by the welding apparatus 500, and welding can be stably performed.

Figure 14:
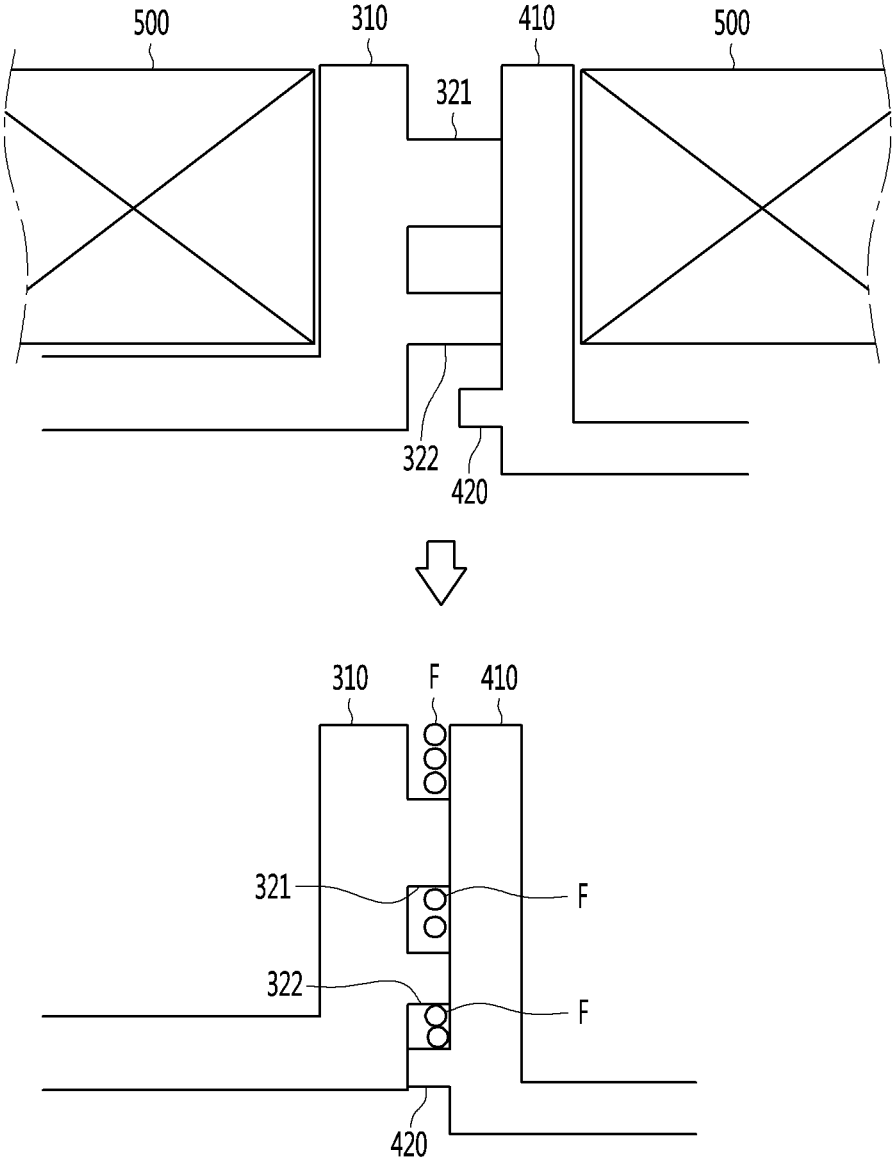
FIG. 14 is a view illustrating the welding structure of the lower portion of the tub by cutting the tub with reference to 14-14' of FIG. 11.

FIG. 14 is a view illustrating the welding structure of the lower portion of the tub by cutting the tub with reference to 14-14' of FIG. 11.

The welding structure illustrated in FIG. 14 is not limited to the welding structure of the lower portion of the tub 100 and relates to a welding structure in the double coupling section in which all the main-coupling protrusion 321 and the sub-coupling protrusion 322 are formed on the first coupling surface 310 and the blocking protrusion 420 is formed on the second coupling surface 410.

Hereinafter, referring to FIG. 14, a welding structure of a region in a main-coupling protrusion 321 and a sub-coupling protrusion 322 are formed on the first coupling surface 310 and the blocking protrusion 420 is formed on the second coupling surface 410 Will be described in detail.

The main-coupling protrusion 321 may be positioned approximately in the middle portion of the first coupling surface 310 in the width direction. Therefore, vibration can be effectively transmitted by the welding apparatus 500.

The sub-coupling protrusion 322 is positioned inside the main-coupling protrusion 321 and may be spaced apart from the main-coupling protrusion 321. The sub-coupling protrusion 322 is inwardly inward from the center of the width of the first coupling surface 310 so that vibration cannot be stably transmitted from the welding apparatus 500 with respect to the main-coupling protrusion 321. However, since the thickness of the sub-coupling protrusion 322 is smaller than the thickness of the main-coupling protrusion 321, the welding can be effectively performed.

Meanwhile, when the coupling protrusion 320 of the first coupling surface 310 is aligned with the second coupling surface 410 for the welding process, the blocking protrusion 420 is positioned in the sub-coupling protrusion 322 and may be positioned to be spaced inwardly from the sub-coupling protrusion (s).

In other words, the blocking protrusion 420 may be positioned closer to the washing space 103 of the tub 100 than the sub-coupling protrusion 322. Therefore, a space for receiving the flash F can be secured between the sub-coupling protrusion 322 and the blocking protrusion 420.

At this time, the inner surface of the blocking protrusion 420 may be positioned on the same extension line as the circumferential surface of the inner space of the first case 300. Therefore, when the first case 300 and the second case 400 are coupled, the blocking protrusions 420 may not protrude into the washing space 103 of the tub 100.

Meanwhile, the flash F generated during welding may occur inside and outside the sub-coupling protrusion 322 and inside and outside the main-coupling protrusion 321.

The flash F generated from the outside of the main-coupling protrusion 321 can escape to the outside of the tub 100 through the space between the first coupling surface 310 and the second coupling surface 410.

The flash F generated inside the main-coupling protrusion 321 and outside the sub-coupling protrusion 322 is restricted in a space between the main-coupling protrusion 321 and the sub-coupling protrusion 322 and may not flow into the tub 100.

In addition, the flash F generated inside the sub-coupling protrusion 322 is restrained in a space between the sub-coupling protrusion 322 and the blocking protrusion 420 and may not flow to the inside of the tub 100.

In other words, the flash F generated from the inside of the coupling protrusion 320 can be prevented from flowing into the tub 100 by the guide protrusion 430 in a region of the second coupling surface 410 on which the guide protrusion 430 is formed.

In addition, the flash F generated from the inside of the coupling protrusion 320 can be prevented from flowing into the tub 100 by the blocking protrusion 420 in a region of the second coupling surface 410 on which the blocking protrusion 420 is formed.

Meanwhile, the coupling protrusion 320 is formed on the first coupling surface 310 and the blocking protrusion 420 and the guide protrusion 430 are formed on the second coupling surface 310 facing the first coupling surface 310 and thus it is possible to more effectively prevent the flash F from flowing into the inside of the tub 100 during welding.

In detail, since the blocking protrusion 420 and the guide protrusion 430 are not welded, in a state where the coupling protrusion 320 is completely welded and shortened, the flash F is formed so as to block the passage of the air into the inside of the tub 100.

In other words, in a state where the welding of the coupling protrusion 320 is not completed and is in progress, a relatively large spacing space may be generated between the first coupling surface 310 and the blocking protrusion 420 and between the first coupling surface 310 and the guide protrusion 430. At this state, a relatively large spacing space between the first coupling surface 310 and the blocking protrusion 420 and between the first coupling surface 310 and the guide protrusion 430 may have a size that the flash F flows therein.

However, since the end portion of the coupling protrusion 320 contacting the second coupling surface 410 is melted, the flash F is generated on a side of the second coupling surface 410. In other words, the flash F is accumulated from a side of the second coupling surface 410 in the space between the first coupling surface 310 and the second coupling surface 410.

At this time, since the blocking protrusion 420 protrudes from the second coupling surface 410, the flash F accumulated from the second coupling surface 410 can be effectively prevented from flowing into the tub 100.

In other words, even if a relatively large spacing space is generated between the first coupling surface 310 and the blocking protrusion 420 in a state where the welding of the coupling protrusion 320 is not completed, the flash F may not flow into the tub 100 since the relatively large spacing space is blocked by the blocking protrusion 420 protruding from the second coupling surface 410.

Likewise, the guide protrusion 430 protrudes from the second coupling surface 410 so that the flash F accumulated from a side of the second coupling surface 410 can be effectively prevented from flowing into the inside of the tub 100.

In other words, even if a relatively large spacing space is generated between the first coupling surface 310 and the guide protrusion 430 in a state where the welding of the coupling protrusion 320 is not completed, the flash F may not flow into the tub 100 since the relatively large spacing space is blocked by the guide protrusion 430 protruding from the second coupling surface 410.

Meanwhile, in the embodiment of the present invention, a state where the coupling protrusion 320 is formed in the first case 300 and the blocking protrusion 420 and the guide protrusion 430 are formed in the second case 400 is described as an example, but it is not limited to the embodiments of the present invention.

Specifically, the blocking protrusion 420 and the guide protrusion 430 may be formed in the first case 300, and the coupling protrusion 320 may be formed in the second case 400.

Meanwhile, in the embodiment of the present invention, a state where the blocking protrusion 420 is formed along the inner end portion of the second coupling surface 410 and is positioned inside the coupling protrusion 320 is described as an example, but, the blocking protrusion 420 may be further formed on the outside of the coupling protrusion 320. In other words, the blocking protrusion 420 may be further formed along the outer end portion of the second coupling surface 410. Therefore, it is possible to prevent the flash F from flowing out to the outside of the tub 100 through the space between the first coupling surface 310 and the second coupling surface 410.

The invention claimed is:

1. A washing machine comprising:

a cabinet;

a tub disposed inside the cabinet, the tub forming a washing space in which washing water is received; and a drum rotatably mounted in the washing space, the drum being configured to receive laundry, wherein the tub includes a first case and a second case coupled to each other to form the washing space;

a first coupling surface formed along an entire periphery of an opened end portion of the first case and configured to extend outward along the periphery of the first case;

a second coupling surface formed along an entire periphery of an opened end portion of the second case facing the first case and configured to extend outward along the periphery of the second case, the second coupling surface being joined to the first coupling surface; and a coupling protrusion protruding from the first coupling surface, a protruding end portion of the coupling protrusion being joined to the second coupling surface, and the coupling protrusion including a main-coupling protrusion protruding from the first coupling surface toward the second coupling surface and configured to extend in a circumferential direction over the entire first coupling surface, and a sub-coupling protrusion protruding from the first coupling surface and configured to extend in parallel with the main-coupling protrusion at a position spaced apart from the main-coupling protrusion, wherein the first coupling surface has different widths extending outwardly at different circumferential positions along the periphery of the first case, wherein the sub-coupling protrusion is formed in a region of the first coupling surface that is relatively wider than a region of the first coupling surface where the sub-coupling protrusion is not formed, and wherein the sub-coupling protrusion is positioned closer to the washing space than the main-coupling protrusion.

2. The washing machine of claim 1, wherein the main-coupling protrusion is thicker than the sub-coupling protrusion.

3. The washing machine of claim 1, wherein the first coupling surface and the second coupling surface each include side-end sections having narrower widths at positions facing respective side surfaces of the cabinet in a lateral direction than at other positions along the first and second coupling surfaces.

4. The washing machine of claim 3, wherein the side-end sections extend in parallel with respective side surfaces of the cabinet in a vertical direction, and wherein a distance between each side-end section and an inside surface of the cabinet is smaller than a distance between respective upper and lower ends of the tub and upper and lower ends of the cabinet.

5. The washing machine of claim 3, wherein the sub-coupling protrusion extends along the first coupling surface except for along the side-end sections.

6. The washing machine of claim 3, wherein each of the first coupling surface and the second coupling surface further includes an upper-end section which has a narrower width at a position facing an upper surface of the cabinet than at other positions along the first and second coupling surfaces, and wherein the sub-coupling protrusion extends along the first coupling surface except for along the side-end sections and the upper-end section.

7. The washing machine of claim 1, wherein the main-coupling protrusion and the sub-coupling protrusion have the same height.

8. The washing machine of claim 1, wherein the first coupling surface includes a connection rib interconnecting the main-coupling protrusion and the sub-coupling protrusion.

9. The washing machine of claim 8, wherein a plurality of connection ribs are disposed at predetermined intervals between the main-coupling protrusion and the sub-coupling protrusion.

10. The washing machine of claim 9, wherein the connection ribs extend in a direction intersecting with the main-coupling protrusion and the sub-coupling protrusion.

11. The washing machine of claim 9, wherein the first coupling surface and the second coupling surface each include a lower end section in a region corresponding to a portion at a lower end of the tub in which washing water is collected, and wherein an interval between the connection ribs is narrower in the lower end section than at other sections along the first and second coupling surfaces.

12. The washing machine of claim 1, wherein the first coupling surface is bonded to the second coupling surface by welding, the washing machine further comprising:

a blocking protrusion that protrudes toward the first coupling surface from the second coupling surface at a position between the first and second coupling surfaces and the washing space and that blocks flash generated during welding of the first and second coupling surfaces from flowing into the washing space.

13. The washing machine of claim 12, wherein the blocking protrusion is formed to be shorter than a protruding length of the coupling protrusion.

14. The washing machine of claim 13, further comprising:

a guide protrusion protruding from the second coupling surface toward the first coupling surface for guiding the coupling protrusion into contact with the second coupling surface when the first case and the second case are coupled.

15. The washing machine of claim 14, wherein the guide protrusion includes an inclined surface that faces the first coupling surface and that is inclined downward toward the outside of the washing space for guiding movement of the guide protrusion into contact with an end portion of the coupling protrusion; and a supporting portion connecting the inclined surface of the guide protrusion to the second coupling surface at a lower end of the inclined surface and configured for supporting the coupling protrusion in a radial direction toward the washing space when the first case and the second case are coupled.

16. The washing machine of claim 14, wherein the first coupling surface and the second coupling surface each include side-end sections having narrower widths at positions facing respective side surfaces of the cabinet in a lateral direction than at other positions along the first and second coupling surfaces, and wherein the guide protrusion is formed along a side-end section.

17. The washing machine of claim 1, wherein the first coupling surface includes:

a double coupling section including the main-coupling protrusion and the sub-coupling protrusion; and a single coupling section which has a narrower width than the double coupling section and only includes the main-coupling protrusion.

* * * * *